US009530296B2

(12) United States Patent
Doyle

(10) Patent No.: US 9,530,296 B2
(45) Date of Patent: Dec. 27, 2016

(54) GRADUATED SENSORY ALERT FOR A PERIMETER SECURITY SYSTEM

(71) Applicant: Kelly Research Corp., Brookfield, WI (US)

(72) Inventor: Alan T. Doyle, Brookfield, WI (US)

(73) Assignee: Kelly Research Corp., Brookfield, WI (US)

( * ) Notice: Subject to any disclaimer, the term of this patent is extended or adjusted under 35 U.S.C. 154(b) by 0 days.

(21) Appl. No.: 14/834,749

(22) Filed: Aug. 25, 2015

(65) Prior Publication Data

US 2016/0027270 A1 Jan. 28, 2016

Related U.S. Application Data

(62) Division of application No. 13/401,495, filed on Feb. 21, 2012, now Pat. No. 9,183,713.
(Continued)

(51) Int. Cl.

| | |
|---|---|
| ***G08B 13/00*** | (2006.01) |
| ***G08B 13/22*** | (2006.01) |
| ***G08B 13/14*** | (2006.01) |
| ***G08B 13/12*** | (2006.01) |
| *G08B 5/36* | (2006.01) |
| *G08B 13/16* | (2006.01) |
| *G08B 13/19* | (2006.01) |
| *G08B 13/196* | (2006.01) |

(52) U.S. Cl.
CPC ..... *G08B 13/22* (2013.01); *G08B 13/122* (2013.01); *G08B 13/1436* (2013.01); *G08B 5/36* (2013.01); *G08B 13/1663* (2013.01); *G08B 13/19* (2013.01); *G08B 13/196* (2013.01)

(58) Field of Classification Search
None
See application file for complete search history.

(56) References Cited

U.S. PATENT DOCUMENTS

| | | |
|---|---|---|
| 3,587,033 A | 6/1971 | Brorein et al. |
| 4,326,272 A | 4/1982 | Rittenbach et al. |

(Continued)

FOREIGN PATENT DOCUMENTS

| | | |
|---|---|---|
| DE | 4114293 | 5/1991 |
| GB | 2404480 | 2/2005 |

(Continued)

*Primary Examiner* — Ojiako Nwugo
(74) *Attorney, Agent, or Firm* — Boyle Fredrickson, S.C.

(57) ABSTRACT

A perimeter security system includes a barrier and a series of sensors. The sensors are connected together via connection cables that include pin-type engagement structure for connection with the sensors. The sensors may include a graduated sensory alert that changes as a person or object approaches. The pin-type connection arrangement includes a receiver having a passage for receiving an insert. The insert and a first end of the cable have matching cross-sections that enable the cable to be inserted within the receiver in a single orientation. A series of pins extend from the cable, and a pin contact arrangement is associated with the receiver. The insert may be one of at least a pair of differently configured inserts, each of which has a cross-section that matches only one end of the cable. Each insert includes an end wall, which includes a series of openings through which the pins extend.

17 Claims, 28 Drawing Sheets

Related U.S. Application Data

(60) Provisional application No. 61/445,158, filed on Feb. 22, 2011, provisional application No. 61/567,493, filed on Dec. 6, 2011.

(56) References Cited

U.S. PATENT DOCUMENTS

| | | | | |
|---|---|---|---|---|
| 4,365,239 | A | 12/1982 | Mongeon | |
| 4,450,434 | A | 5/1984 | Nielsen et al. | |
| 4,494,092 | A | 1/1985 | Griffin | |
| 4,562,428 | A * | 12/1985 | Harman | G08B 13/2491 340/505 |
| 4,609,909 | A | 9/1986 | Miller et al. | |
| 4,694,932 | A | 9/1987 | Schmitt | |
| 4,695,740 | A | 9/1987 | Carter | |
| 4,713,557 | A | 12/1987 | Carter | |
| 4,772,875 | A | 9/1988 | Maddox et al. | |
| 4,800,366 | A | 1/1989 | Hussmann | |
| 4,835,418 | A | 5/1989 | Hsich | |
| 4,857,912 | A | 8/1989 | Everett, Jr. et al. | |
| 4,982,115 | A | 1/1991 | Lee | |
| 5,079,693 | A | 1/1992 | Miller | |
| 5,107,148 | A | 4/1992 | Millman | |
| 5,107,507 | A | 4/1992 | Bland et al. | |
| 5,132,987 | A | 7/1992 | Motohashi et al. | |
| 5,173,619 | A | 12/1992 | Gaudenzi et al. | |
| 5,202,661 | A | 4/1993 | Everett, Jr. et al. | |
| 5,214,330 | A | 5/1993 | Okazaki et al. | |
| 5,214,638 | A | 5/1993 | Norz et al. | |
| 5,248,908 | A | 9/1993 | Kimura | |
| 5,295,246 | A | 3/1994 | Bischoff et al. | |
| 5,300,835 | A | 4/1994 | Assar et al. | |
| 5,381,062 | A | 1/1995 | Morris | |
| 5,418,933 | A | 5/1995 | Kimura et al. | |
| 5,428,649 | A | 6/1995 | Cecchi | |
| 5,428,800 | A | 6/1995 | Hsieh et al. | |
| 5,485,142 | A | 1/1996 | Stute et al. | |
| 5,517,135 | A | 5/1996 | Young | |
| 5,627,480 | A | 5/1997 | Young et al. | |
| 5,644,729 | A | 7/1997 | Amini et al. | |
| 5,715,405 | A | 2/1998 | McClear et al. | |
| 5,736,870 | A | 4/1998 | Greason et al. | |
| 5,764,915 | A | 6/1998 | Heimsoth et al. | |
| 5,790,526 | A | 8/1998 | Kniess et al. | |
| 5,808,492 | A | 9/1998 | Chow | |
| 5,859,545 | A | 1/1999 | Thornblad | |
| 5,917,348 | A | 6/1999 | Chow | |
| 5,923,187 | A | 7/1999 | Maugars | |
| 5,977,871 | A | 11/1999 | Miller et al. | |
| 6,046,605 | A | 4/2000 | Ziemkowski et al. | |
| 6,060,906 | A | 5/2000 | Chow et al. | |
| 6,075,384 | A | 6/2000 | Sim et al. | |
| 6,091,729 | A | 7/2000 | Dove | |
| 6,209,395 | B1 | 4/2001 | Kristensen | |
| 6,275,066 | B1 | 8/2001 | Park et al. | |
| 6,288,640 | B1 | 9/2001 | Gagnon | |
| 6,512,478 | B1 | 1/2003 | Chien | |
| 6,513,090 | B1 | 1/2003 | Jeddeloh | |
| 6,621,947 | B1 | 9/2003 | Tapanes et al. | |
| 6,650,174 | B2 | 11/2003 | Bell | |
| 6,651,104 | B1 | 11/2003 | Moon | |
| 6,664,894 | B2 | 12/2003 | Pakhomov | |
| 6,778,469 | B1 | 8/2004 | McDonald | |
| 6,778,717 | B2 | 8/2004 | Tapanes et al. | |
| 6,816,073 | B2 | 11/2004 | Vaccaro et al. | |
| 6,822,480 | B1 | 11/2004 | McCalmont | |
| 6,834,318 | B2 | 12/2004 | Hunter et al. | |
| 6,842,806 | B2 | 1/2005 | Ervin | |
| 6,857,040 | B2 | 2/2005 | Noonan et al. | |
| 6,937,151 | B1 | 8/2005 | Tapanes | |
| 6,956,478 | B2 | 10/2005 | Oyagi et al. | |
| 6,973,037 | B1 | 12/2005 | Kahveci | |
| 6,980,483 | B2 | 12/2005 | McDonald | |
| 7,032,051 | B2 | 4/2006 | Reay | |
| 7,049,952 | B2 | 5/2006 | Kulesz et al. | |
| 7,061,274 | B2 | 6/2006 | George | |
| 7,119,681 | B2 | 10/2006 | Eskildsen | |
| 7,161,483 | B2 | 1/2007 | Chung | |
| 7,205,793 | B2 | 4/2007 | George | |
| 7,218,149 | B2 | 5/2007 | Arai | |
| 7,292,067 | B2 | 11/2007 | Schwarz | |
| 7,321,241 | B1 | 1/2008 | Marak et al. | |
| 7,348,803 | B2 | 3/2008 | Bui et al. | |
| 7,450,006 | B1 | 11/2008 | Doyle et al. | |
| 7,668,202 | B2 | 2/2010 | Gillet | |
| 7,692,450 | B2 | 4/2010 | Aranovsky | |
| 2002/0018473 | A1 | 2/2002 | Hassell et al. | |
| 2002/0073261 | A1 | 6/2002 | Kosaraju | |
| 2003/0072264 | A1 | 4/2003 | Mo et al. | |
| 2003/0198425 | A1 | 10/2003 | Tapanes et al. | |
| 2004/0071382 | A1 | 4/2004 | Rich et al. | |
| 2005/0146358 | A1 | 7/2005 | Barus et al. | |
| 2005/0147340 | A1 | 7/2005 | Tapanes | |
| 2005/0174246 | A1 | 8/2005 | Picco et al. | |
| 2006/0038587 | A1 | 2/2006 | Barus et al. | |
| 2006/0075170 | A1 | 4/2006 | Behrendt et al. | |
| 2006/0227001 | A1 * | 10/2006 | Petricoin | G08B 3/10 340/815.4 |
| 2007/0120668 | A1 | 5/2007 | Boyd et al. | |
| 2008/0165046 | A1 * | 7/2008 | Fullerton | G01S 7/003 342/21 |
| 2009/0072971 | A1 | 3/2009 | Doyle et al. | |
| 2011/0153277 | A1 * | 6/2011 | Morath | G01D 3/08 702/188 |

FOREIGN PATENT DOCUMENTS

| | | |
|---|---|---|
| GB | 2409085 | 6/2005 |
| JP | 06348971 | 12/1994 |
| JP | 2006163659 | 6/2006 |
| JP | 2010250462 | 11/2010 |
| KR | 100907559 | 7/2009 |
| WO | 2007117579 | 10/2007 |

* cited by examiner

GRADUATED SENSORY ALERT FOR A PERIMETER SECURITY SYSTEM

CROSS-REFERENCE TO RELATED APPLICATION

This application is a division of U.S. application Ser. No. 13/401,495, filed Feb. 21, 2012, which claims priority to U.S. Provisional Patent Application No. 61/445,158 filed on Feb. 22, 2011, and U.S. Provisional Patent Application No. 61/567,493 filed on Dec. 6, 2011, the entireties of which are hereby incorporated by explicit reference thereto.

BACKGROUND AND SUMMARY

The present invention relates to a security system, and more particularly to a fence-type perimeter security system.

Various fence-type perimeter security systems are configured to provide a monitoring function in combination with the physical barrier provided by the fence itself. Known systems, however, involve a number of drawbacks. For instance, many known perimeter security systems are relatively expensive, are susceptible to false alarms, and are difficult and time consuming to install. The security system of the present invention was developed to address such drawbacks of prior art systems.

In accordance with one aspect of the present invention, a perimeter security system includes a barrier and a series of sensors secured to the barrier at spaced locations along the length of the barrier. The sensors are interconnected with a server or monitor at a location remote from the sensors, and each sensor includes a housing defining an interior within which one or more sensing components are contained. A series of connection cables extends between and connects adjacent sensors to each other and connect the sensors to the monitor. Each sensor includes first and second connectors. A first connection cable extends between the first connector and a connector associated with a first adjacent sensor, and a second one of the connection cables extends between the second connector and a connector associated with an a second adjacent sensor. The first and second connectors and the connection cables include pin-type engagement structure for connecting the connection cables to the sensors. One or more of the sensors may include a camera, and the sensors and cables include communication means for communicating the camera outputs to the monitor.

In accordance with another aspect of the invention, a perimeter security system includes a barrier and a series of sensors secured to the barrier at spaced locations along the length of the barrier. Each sensor includes a detector for sensing the presence of a person or object in the vicinity of the sensor. In addition, each sensor further includes a graduated sensory alert that changes as the person or object approaches the sensor. The sensors are interconnected with a monitor at a location remote from the sensors. In one embodiment, the graduated sensory alert may be in the form of a visual alert. The visual alert may be a light emitting arrangement that changes color as the person or object approaches the sensor.

The present invention also contemplates a pin-type electrical connection arrangement, which representatively may be used to connect together the sensors in a perimeter security system, although the pin-type electrical connection arrangement may be used in other applications. In accordance with this aspect of the invention, a pin-type electrical connection arrangement includes an electrically conductive member and a cable terminating in a pair of ends. A receiver defines a passage within which the end of the cable is received. An insert is secured within the passage of the receiver, and the insert and a first end of the cable have matching cross-sections that enable the first end of the cable to be inserted within the receiver in a single predetermined orientation. A series of pins extend from one of the receiver and the first end of the cable, and a pin contact arrangement is associated with the other of the receiver and the first end of the cable. The pins are engageable with the pin contact arrangement when the first end of the cable is inserted into the receiver passage. The insert may be one of at least a pair of differently configured inserts, each of which has a cross-section that matches only one of the ends of the cable. The receiver defines an open end, and each insert includes an end wall that is exposed when the insert is secured within the passage of the receiver. The end wall includes a series of openings through which the pins extend. In one form, the electrically conductive member may be a circuit board.

Various other features, objects and advantages of the invention will be made apparent from the following detailed description taken together with the drawings

BRIEF DESCRIPTION OF THE DRAWINGS

The drawings illustrate the best mode presently contemplated of carrying out the invention. In the drawings.

DETAILED DESCRIPTION

Figure 1:
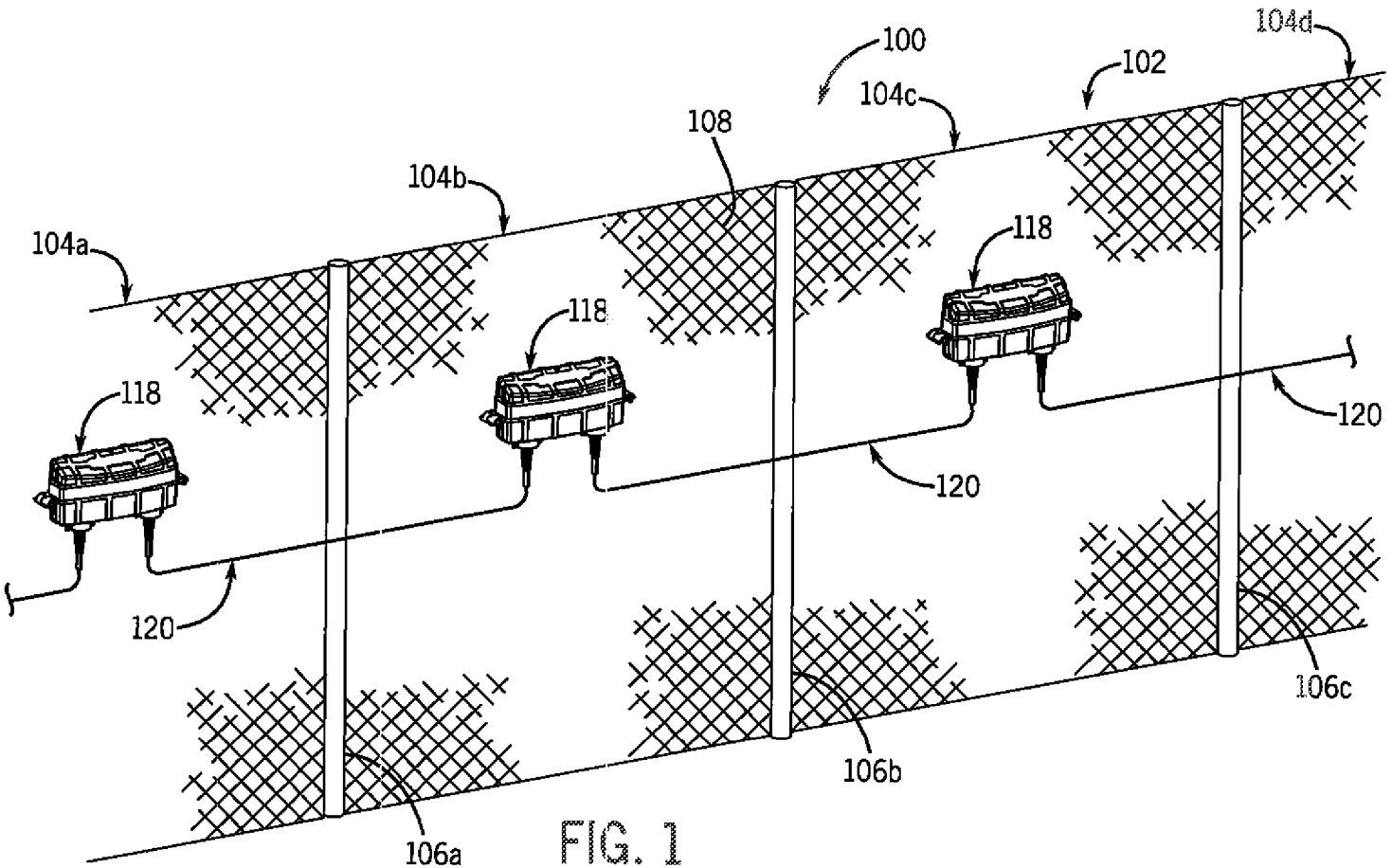
FIG. 1 is a partial isometric view illustrating a section of a fence-type perimeter security system in accordance with the present invention.

As shown in FIG. 1, a perimeter security system 100 in accordance with the present invention generally includes a barrier structure in combination with a monitoring and alert system. In the illustrated embodiment, the perimeter security system 10 has a barrier structure in the form of a fence 102, which may be formed of a number of interconnected fence sections shown at 104*a*, 104*b*, 104*c* and 104*d*. In a manner as is known, the fence sections 104*a*-104*d* are formed of a series of fence posts such as 106*a*, 106*b*, 106*c*, which serve to support fence material 108. In the illustrated embodiment, the fence material 108 is in the form of chain-link fencing, although it is understood that any other satisfactory fence material or fence construction may be employed.

Figure 2:
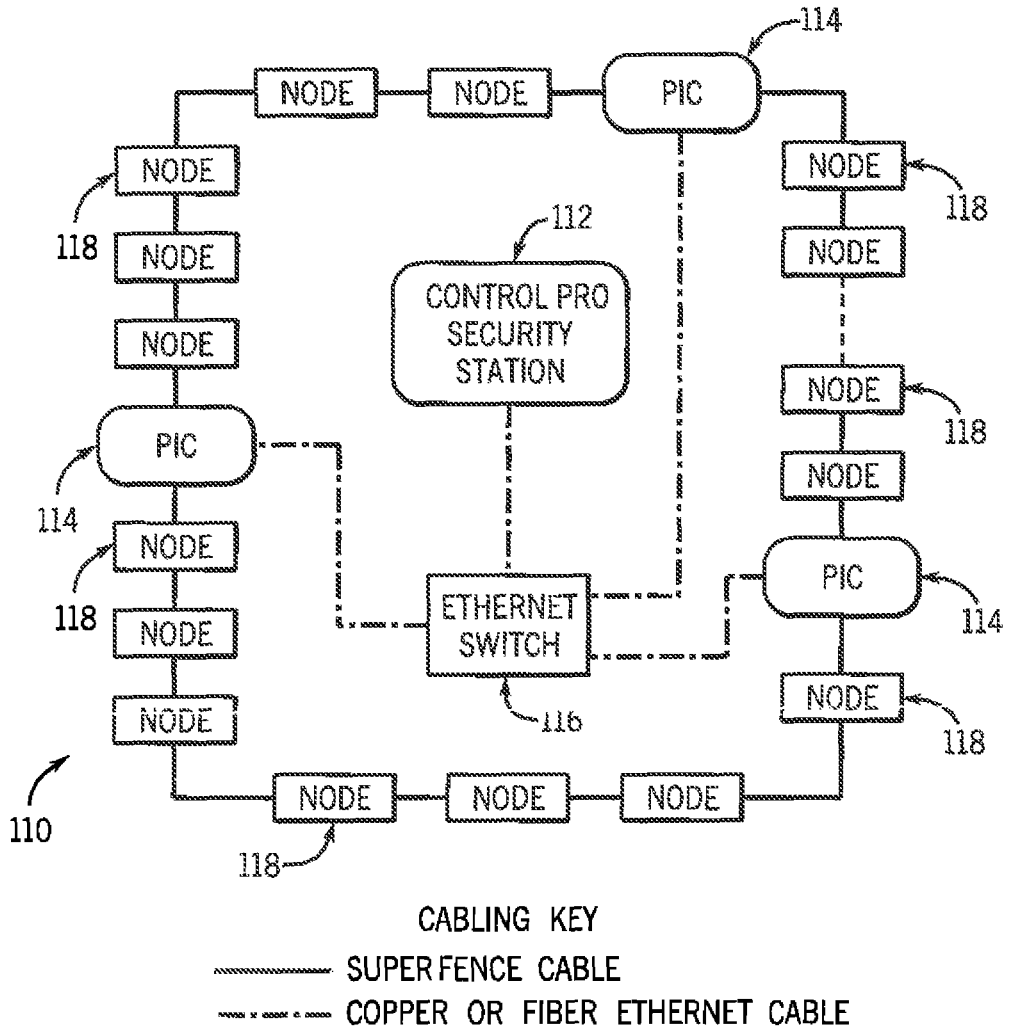
FIG. 2 is a schematic view illustrating the sensors and monitoring components incorporated in the security system of FIG. 1.
Figure 3:
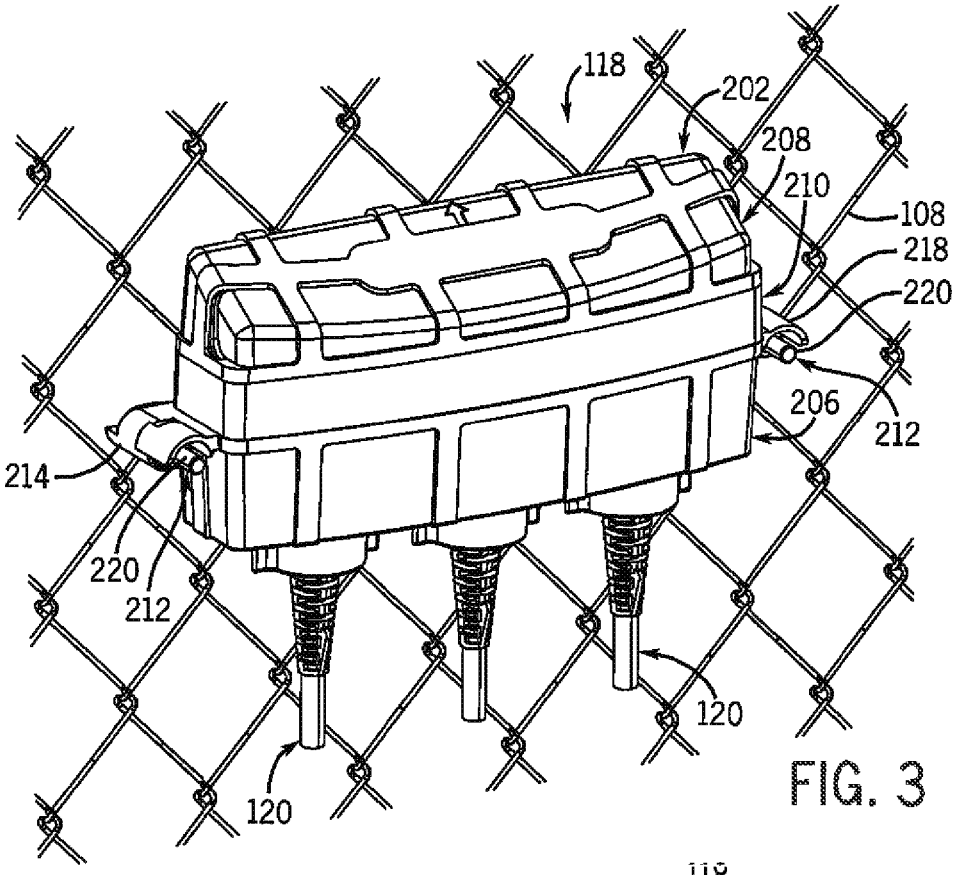
FIG. 3 is a front isometric view illustrating a portion of a fence and one of the sensors incorporated in the security system of FIG. 1.
Figure 4:
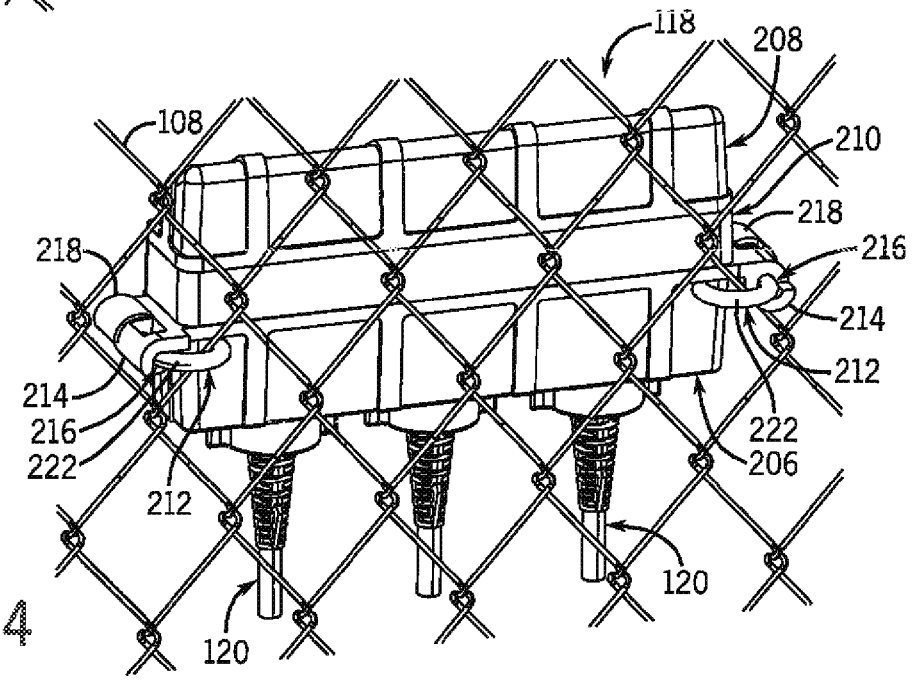
FIG. 4 is a rear isometric view illustrating a portion of a fence and the sensor of FIG. 4.
Figure 5:
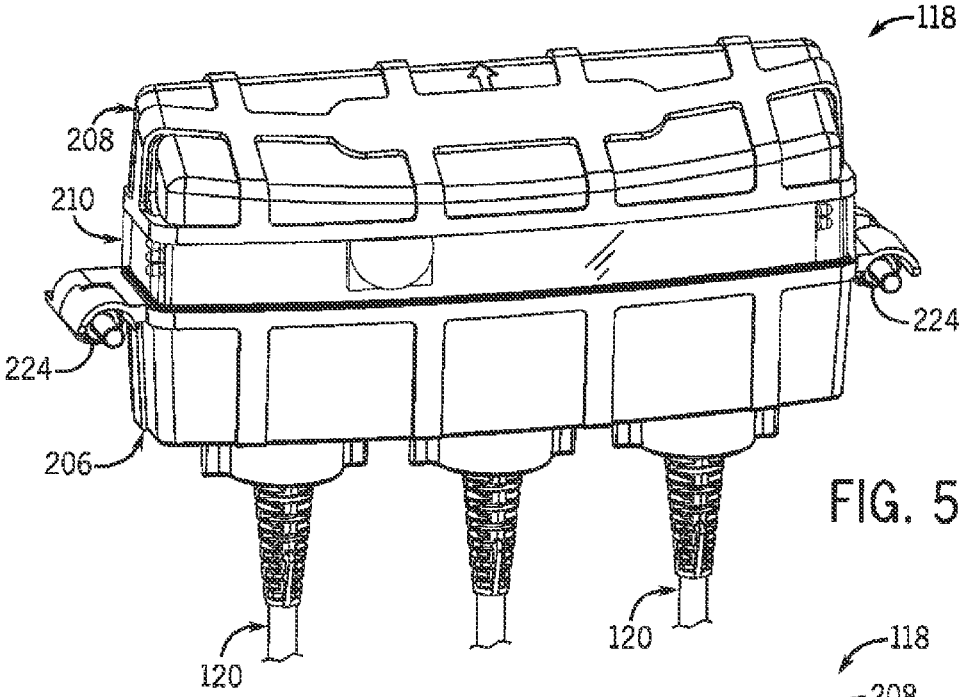
FIG. 5 is a front isometric view of a sensor similar to the view of FIG. 2.
Figure 6:
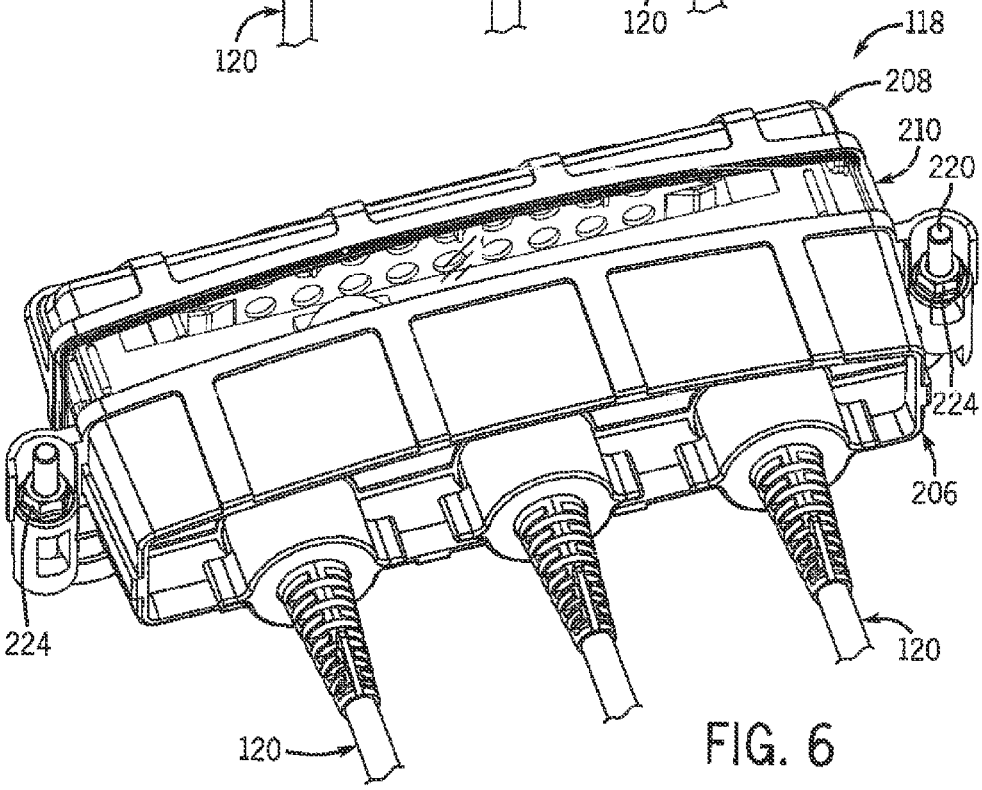
FIG. 6 is a bottom front isometric view of the sensor of FIG. 5.
Figure 7:
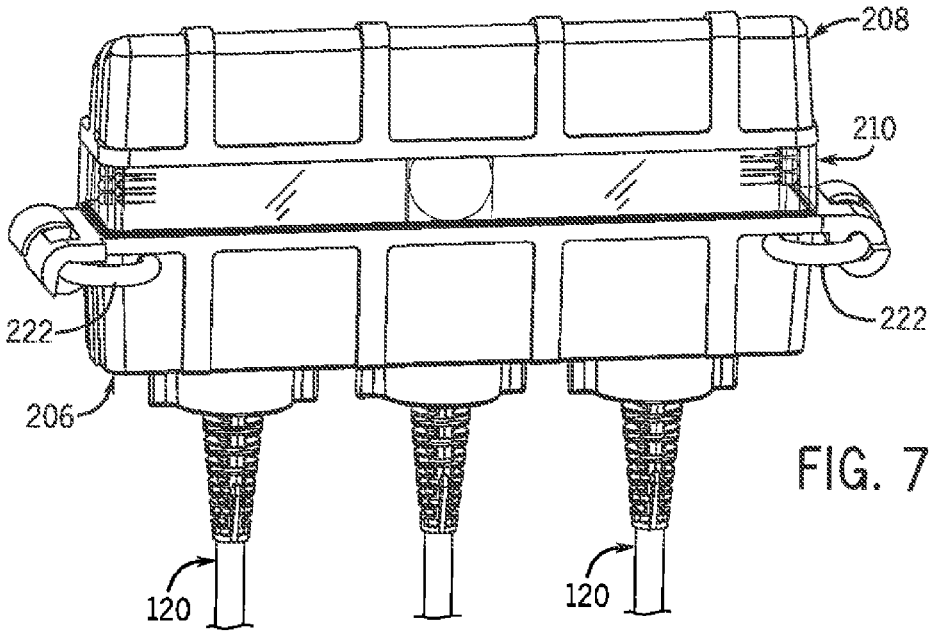
FIG. 7 is a rear elevation view of the sensor of FIG. 5.
Figure 8:
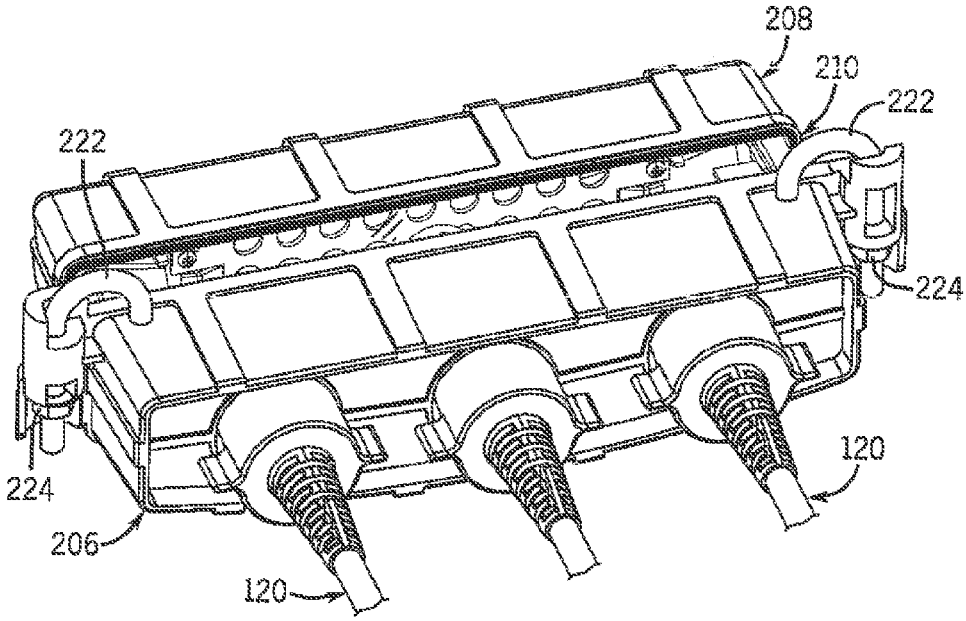
FIG. 8 is a bottom rear isometric view of the sensor of FIG. 5.

The monitoring and alert system incorporated in the perimeter security system 100 of the present invention is shown at 110 in FIG. 2. The monitoring and alert system 110 generally includes a central security station 112, a series of perimeter interface controllers 114 connected to the central security station 112 via a switch 116, and a series of sensors in the form of monitoring and alert modules or nodes 118 which are interconnected with the perimeter interface controllers 114. In a representative application as shown in FIG. 1, a node 118 may be secured to each section, such as 104*a*, 104*b*, 104*c*, etc. of fence 102, and the nodes 118 are connected in series via connection cables 120. In a manner to be explained, the nodes 118 are operable to detect movement of fence material 108 as well as movements within the vicinity of fence 102, and to convey signals indicating such movements to security station 112 for security purposes.

FIGS. 3-10 illustrate the overall construction of one of nodes 118 and the manner in which the nodes 118 are secured to the fence material 108.

Each node 118 generally includes a housing 202 within which various sensing, monitoring and alert components are contained, in a manner to be explained. Each housing 202 is securely fastened to the fence material 108 of one of the fence sections 104*a*, 104*b*, etc., so that any movement of the fence material 108 also results in movement of the housing 202 along with the fence material 108. In the illustrated embodiment, the housing 202 is made up of a lower section 206, an upper section 208, and an intermediate section 210, which are configured and adapted to be secured together to form a sealed, weatherproof interior volume within which the sensing, monitoring and alert components of node 118 are contained. In one embodiment, the lower section 206, upper section 208 and intermediate section 210 are adapted to be connected together by sonic welding, adhesive, etc. so as to provide a sealed, weather-tight interior of the housing 202. Alternatively, the lower section 206, upper section 208 and intermediate section 210 may be secured together using mechanical fasteners such as screws, rivets or nuts and bolts, with appropriate seals or gaskets being located at the interfaces between the lower section 206, upper section 208 and intermediate section 210 to seal the interior of the housing 202. The latter construction enables the housing sections to be disassembled and reassembled, such as for service, maintenance or repair. For reasons to be explained, the intermediate housing section 210 is formed of a transparent or translucent material, e.g. a transparent or translucent thermoplastic material, which enables light to pass into and out of the interior of housing 202.

In the illustrated embodiment, each node 118 is secured to its associated fence section 104*a*, 104*b*, etc. using a mechanical connection of the housing 202 to the fence material 108 of the fence section. Representatively, the housing 202 is secured to the fence material 108 using fence clips or retainers 212, which function to secure the housing 202 to the fence material 108. In the illustrated embodiment, the housing 202 includes a pair of clip mounts 214 located one at each end of the lower section 206 of housing 202. Each clip mount 214 includes a passage 216 extending in a front-rear direction, and a hood 218 is located adjacent the front area of clip mount 214. Each fence clip 212 is in the form of a J-shaped member, including an axial shank 220 and a hook section 222 that extends laterally from shank 220.

In order to mount the node 118 to the fence material 108, the housing 202 of the node 118 is placed against one side of the fence material 108, e.g. against the outside of the fence. The fence clip 212 is then passed through an opening in the fence to the opposite side of the fence, and the shank 220 of the fence clip 212 is inserted in a rearward-to-forward direction into the passage 216 defined by the clip mount 214. In this manner, the hook section 222 of the fence clip 212 is advanced toward the rear of the housing 202 as the shank 220 of the fence clip 212 is moved forwardly within the passage 216 of clip mount 214. The housing 202 is positioned on the fence material 108 such that, as the fence clip 212 is advanced toward the rear of housing 202, the hook section 222 of fence clip 212 catches one of the links in the fence material 108 and traps the link against the rear of the housing 202.

The shank 220 of each fence clip 212 has a threaded end, which is moved to a position under the hood 218 as the shank 220 is advanced into and through the passage 216 in clip mount 214. When the shank 220 is in a position at which the threaded end extends outwardly of the passage 216, a nut 224 is threaded onto the threaded end of the shank 220. Nut 224 is located under the hood 218, which provides a degree of weather protection for the connection of nut 224 to the shank 220 of fence clip 212. The nut 224 is then turned against the forward end of the clip mount 214, which draws the fence clip 212 forwardly so as to move the shank 220 within the passage 216 and advance the hook section 222 toward the rear of housing 202. When the fence clip 212 is fully advanced by rotation of nut 224 in this manner, the hook section 222 functions to trap the fence link against the rear of housing 202. Using a fence clip 212 secured to the clip mount 214 at each end of housing 202, the housing 202 is securely engaged with and retained on the fence material 108. With the housing 202 of the node 118 secured to the fence material 108 this manner, any movement of the fence material 108 is transferred to and experienced by the node 118.

As can be readily appreciated, one person can install the node 118 on the fence material 108 without the need to have another person on the opposite side of the fence section. The installation of the nodes 118 on the fence sections is thus quick and easy, and can be accomplished with minimal personnel.

It should be understood that the mounting arrangement for securing the node 118 to the fence material 108 is but one representative way by which the node 118 may be secured to the fence material 108. Other satisfactory mounting systems and methods may also be used as long as the result is a secure connection of the node 118 to the material of the fence section.

FIGS. 11-15 illustrate the manner in which the various internal components of the node 118 are contained within the interior of the housing 202. In the illustrated embodiment, the internal components of the node 118 include an upper, generally vertical printed circuit board (PCB) 228, a lower, generally horizontal PCB 230, an upstream connector 232 and a downstream connector 234. The interior of housing 202 also contains a perforated desiccant cover 236, which is secured to the inside of upper housing section 208, such as by a series of screws 238 that extend through openings in desiccant cover 236 into engagement with mounting bosses formed in the interior of upper housing section 208. With this arrangement, a quantity of desiccant material is contained within the interior of upper housing section 208 and supported by desiccant cover 236, so as to absorb moisture that may be present in the interior of housing 202.

The upper PCB 228 includes a downwardly facing connector 240 at its lower edge, and the lower PCB 230 includes an upwardly facing connector 242 that is configured to mate with upper PCB connector 240. Engagement of connectors 240, 242 functions to connect together the circuits of upper and lower PCBs 228, 230, respectively.

Upper PCB 228 carries sensing and indicator components associated with the node 118. Representatively, the upper PCB 228 may include an accelerometer-based system for detecting movement of node 118. The arrangement and operation of the accelerometer-based motion detection system is shown and described in Doyle et al. U.S. Pat. Nos. 7,692,540; 7,688,202; and 7,450,006, the entire disclosures of which are hereby incorporated by reference. In the illustrated embodiment, the upper PCB 228 carries one or more accelerometers for detecting movement of the node 118 and that are used in operation of the security threat confirmation and determination system disclosed in the noted patents.

In addition, upper PCB 228 carries a pair of passive infrared sensors 244, 246 secured to opposite sides of upper PCB 228 to sense external motion on either side of node 118 and to provide corresponding inputs to upper PCB 228 in response to any such external movements. As noted previously, the material intermediate housing section 210 is transparent or translucent, which enables infrared sensors 244, 246 to sense motion within a predetermined range exteriorly of the node housing 202 in the directions from which a person or object would approach the area that is secured by the fence section to which the node 118 is mounted. In addition, upper PCB includes opposed sets of matching LED indicator lights, shown generally at 248. In the illustrated embodiment, the LED indicator lights 248 are mounted to the side edges of upper PCB 228, although it is understood that the LED indicator lights 248 may be in any other satisfactory location on upper PCB 228. Each set of indicator lights 248 may include a green LED 250, a yellow LED 252, and a red LED 254, the function of which will later be explained. Like the infrared sensors 244, 246, the indicator lights 248 are configured and arranged so as to be in alignment with the transparent or translucent intermediate housing section 210. In this manner, the infrared sensors 244, 246 sense motion exteriorly of the housing 202 through the intermediate housing section 210, and light that is emitted by the indicator lights 248 is able to pass through the intermediate housing section 210 so as to be visible from the exterior of the housing 202. The infrared sensors 244, 246 are interconnected with the LEDs 250-254 by a circuit, and operate so as to illuminate green LED 250 during normal operation. When the sensors 244, 246 detect movement within the predetermined range exteriorly of the housing 202, the circuit illuminates the yellow LED 252. In the event the exterior movement comes closer than a predetermined and preprogrammed range, the circuit illuminates the red LED 254.

Figure 11:
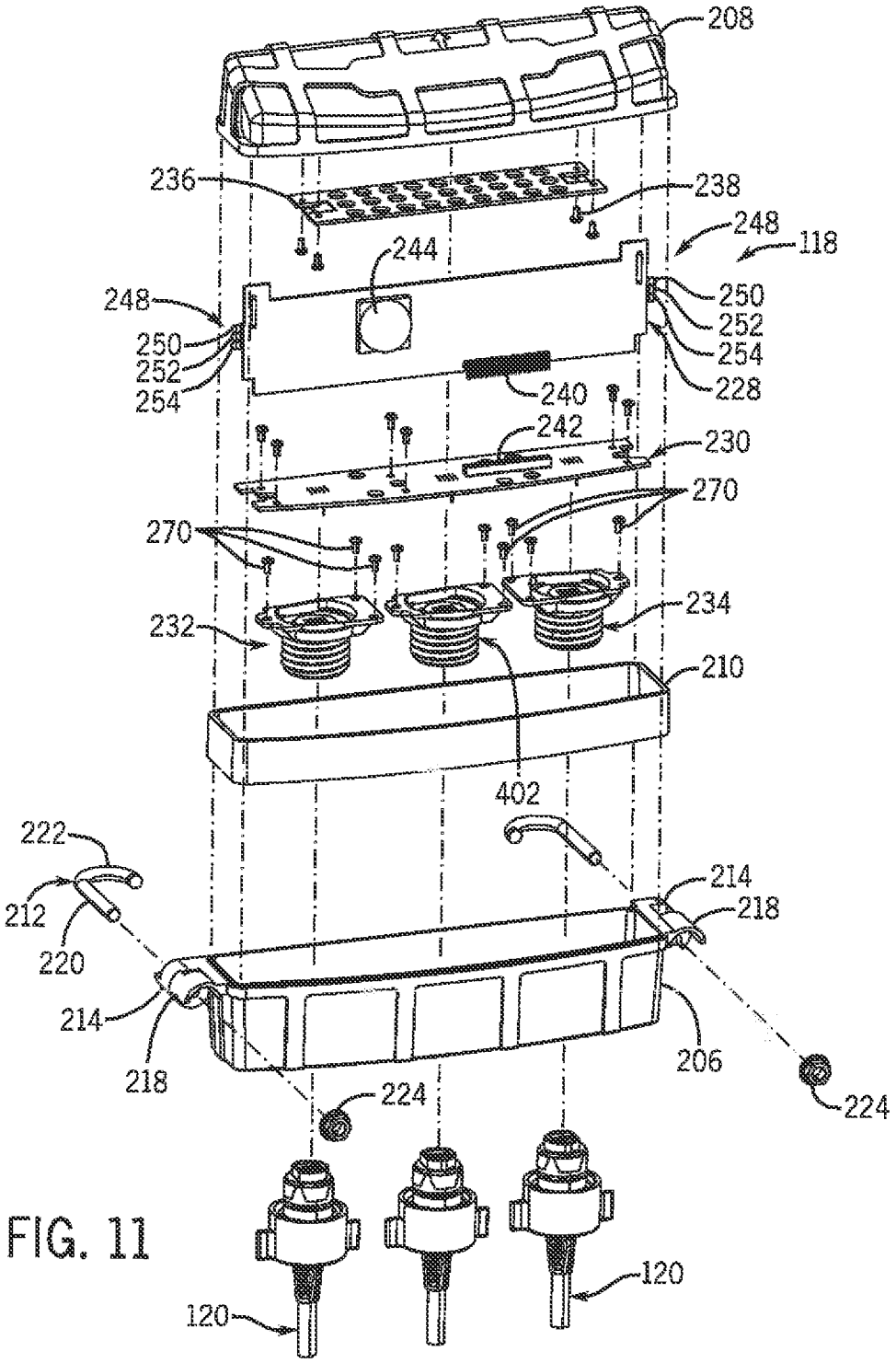
FIG. 11 is an exploded isometric view showing the components of the sensor of FIG. 5.
Figure 16:
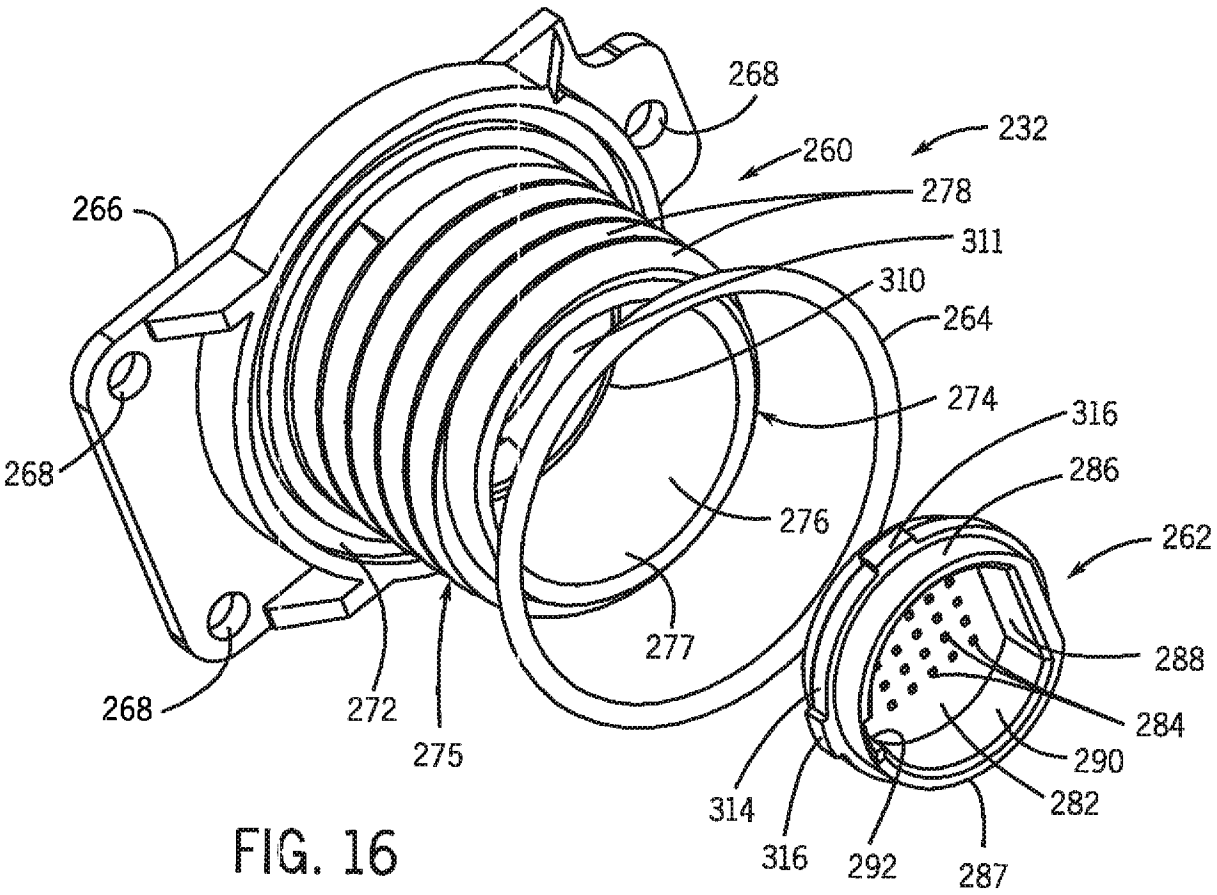
FIG. 16 is an exploded bottom isometric view illustrating one of the cable connectors incorporated in the sensor of FIG. 5, which may representatively be an upstream cable connector.

As shown in FIG. 16, the upstream connector 232 generally includes a hollow externally threaded male connector housing 260, a keyed upstream connector insert 262 and an O-ring 264. Connector housing 260 is formed with an upper mounting flange 266 that includes a series of openings 268. As shown in FIG. 11, the upper mounting flange 266 is adapted to face and engage the underside of lower PCB 230, and a series of fasteners such as screws 270 extend through aligned openings in lower PCB 230 into engagement with the openings 268, so as to securely mount the connector housing 260 to lower PCB 230. Below mounting flange 266, connector housing 260 is formed to include a peripheral groove or recess 272, within which O-ring 264 is received. In addition, connector housing 260 defines a generally cylindrical body portion 274 that extends from flange 266, and which includes a side wall 275 having an inner surface 277 that defines an internal passage 276. A series of external threads 278 are formed on the external surface of side wall 275.

Figure 17:
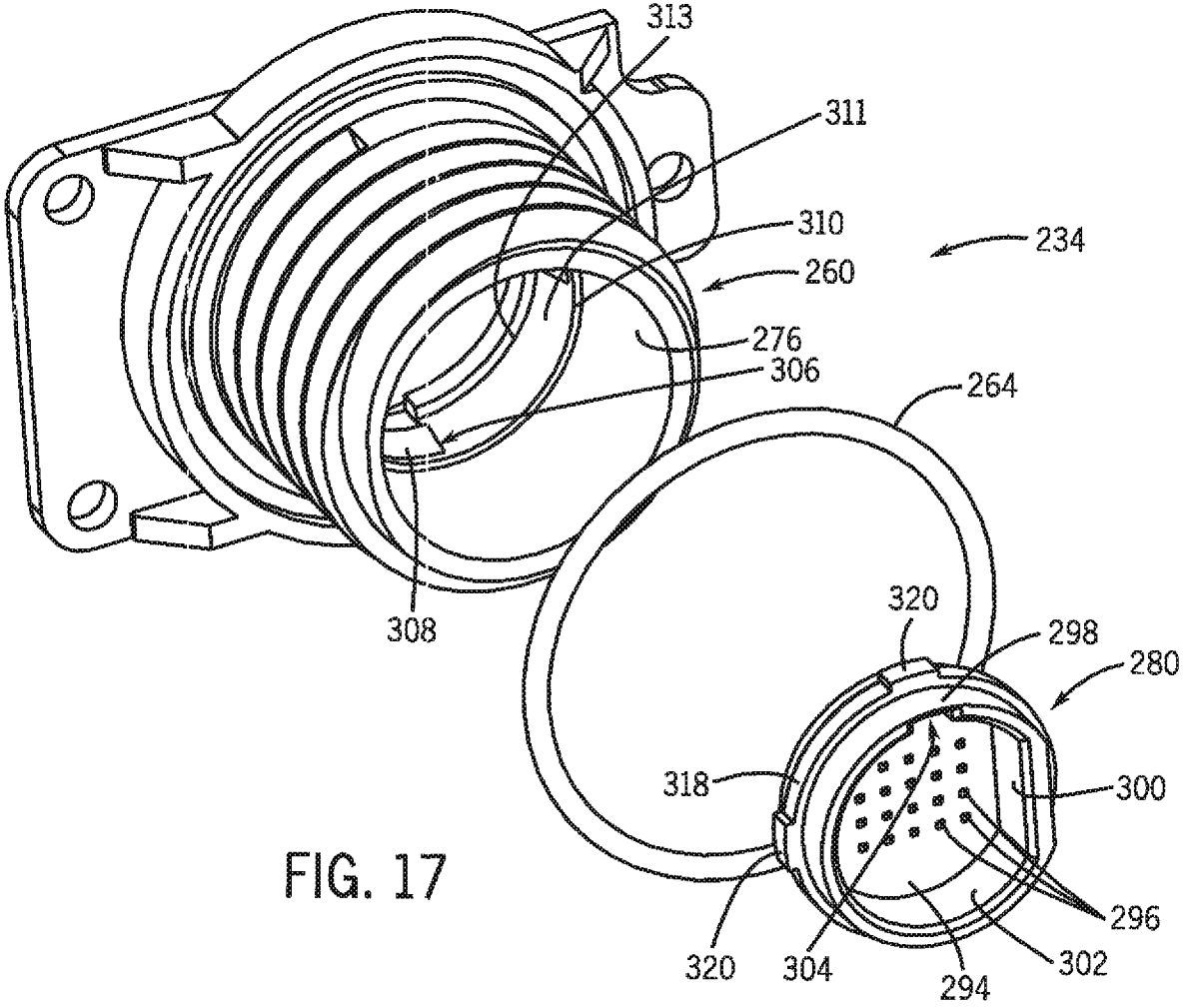
FIG. 17 is an exploded bottom isometric view illustrating one of the cable connectors incorporated in the sensor of FIG. 5, which may representatively be a downstream cable connector.

FIG. 17 illustrates a downstream connector 234, which is constructed similarly to upstream connector 232 and includes an externally threaded male connector housing 260, a keyed downstream connector insert 280 and an O-ring 264. With the exception of connector insert 280, downstream connector 234 is constructed similarly to upstream connector 232 and is mounted to lower PCB 230 in the same manner as described above with respect to upstream connector 232.

As shown in FIGS. 16 and 19, upstream connector insert 262 includes a pin guide wall 282 having a series of pin guide openings 284 arranged in columns and rows. A peripheral side wall 286 extends from pin guide wall 282 and terminates in an outer edge 287. Side wall 286 is formed so as to have an irregular or non-circular shape. In the illustrated embodiment, the side wall 286 has a generally circular shape that includes a flat 288. The side wall 286 defines an internal cavity or recess 290, which is closed at its inner end by pin guide wall 282. Side wall 286 also is formed to include an inwardly facing notch 292, which is diametrically opposed from flat 288.

Similarly, as shown in FIGS. 17 and 20, downstream connector insert 280 includes a pin guide wall 294 having a series of pin guide openings 296 arranged in columns and rows. A peripheral side wall 298 extends from pin guide wall 296, and is formed so as to have an irregular or non-circular shape. In the illustrated embodiment, the side wall 298 has a generally circular shape that includes a flat 300. The side wall 298 defines an internal cavity or recess 302, which is closed at its inner end by pin guide wall 294. Side wall 298 also is formed to include an inwardly facing notch 304, which is located at 90 degrees relative to flat 300.

Figure 18A:
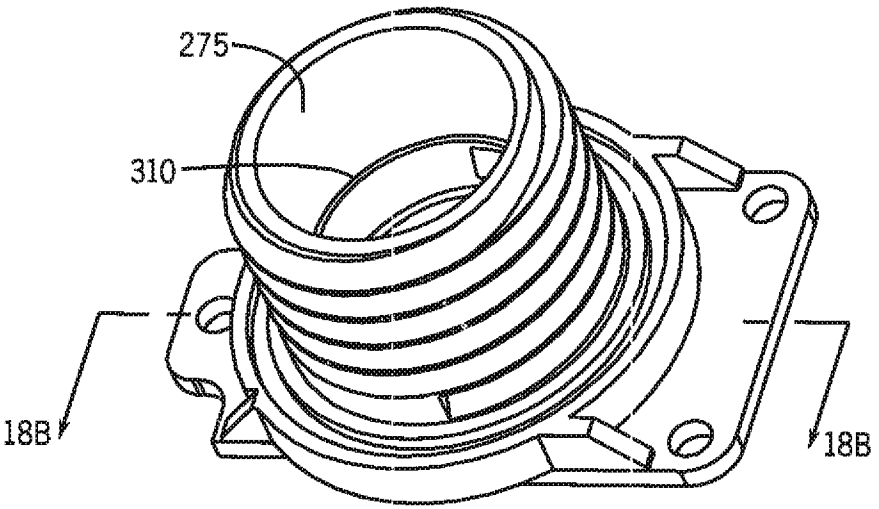
FIG. 18A is an isometric view showing the body portion of a cable connector housing that may be incorporated into the cable connectors of FIGS. 16 and 17.
Figure 18B:
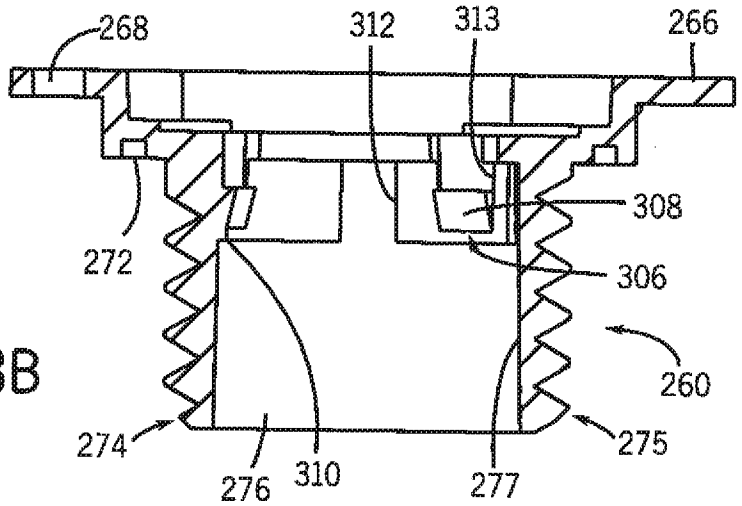
FIG. 18B is a section view taken along line 18B-18B of FIG. 18A.
Figure 19A:
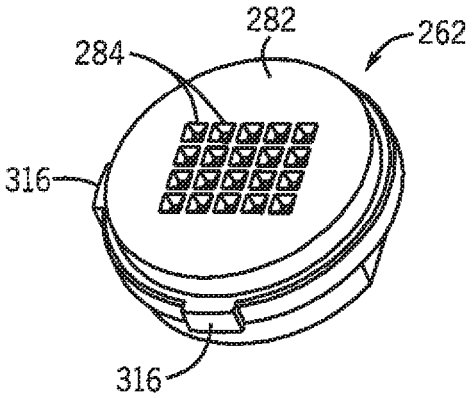
FIG. 19A is a top isometric view of an insert incorporated in the upstream cable connector of FIG. 16.
Figure 19B:
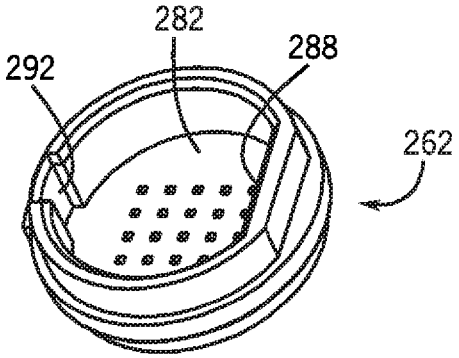
FIG. 19B is a bottom isometric view of the insert of FIG. 19A.
Figure 19C:
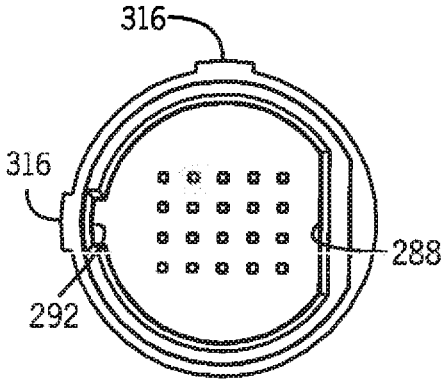
FIG. 19C is a bottom plan view of the insert of FIG. 19A.
Figure 19D:
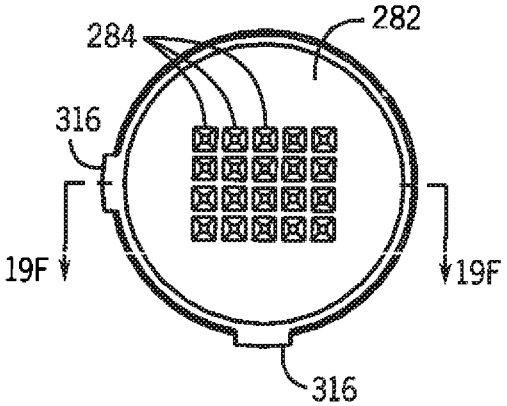
FIG. 19D is a top plan view of the insert of FIG. 19A.
Figure 19E:
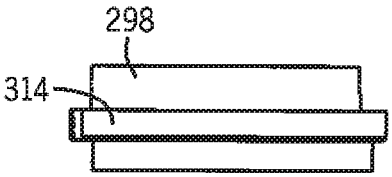
FIG. 19E is a side elevation view of the insert of FIG. 19A.
Figure 19F:
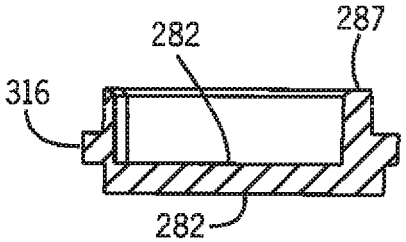
FIG. 19F is a section view taken along line 19F-19F of FIG. 19D.
Figure 20A:
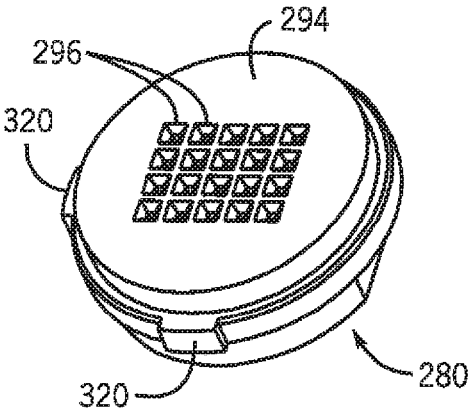
FIG. 20A is a top isometric view of an insert incorporated in the downstream cable connector of FIG. 17.
Figure 20B:
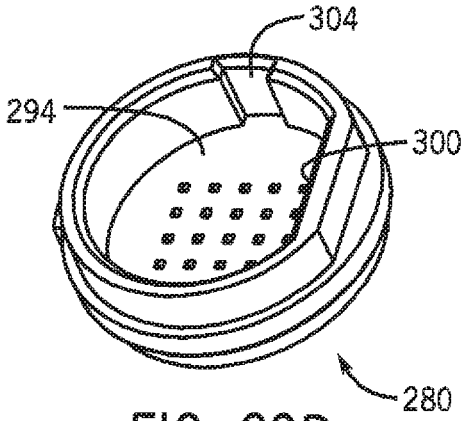
FIG. 20B is a bottom isometric view of the insert of FIG. 20A.
Figure 20C:
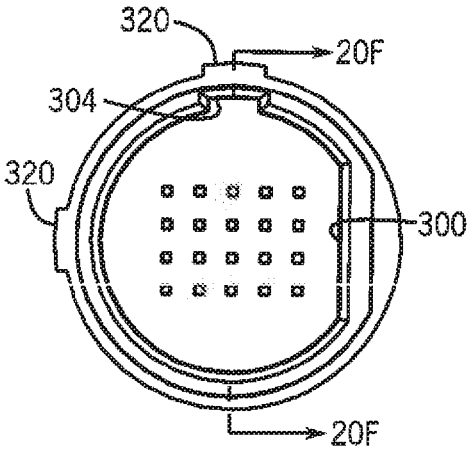
FIG. 20C is a bottom plan view of the insert of FIG. 20A.
Figure 20D:
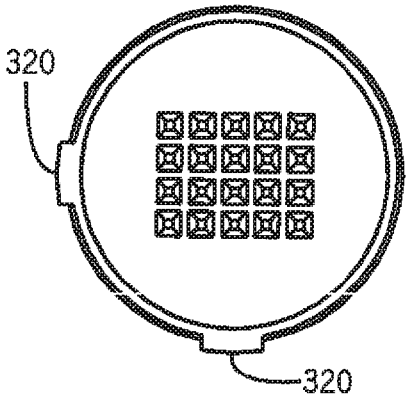
FIG. 20D is a top plan view of the insert of FIG. 20A.
Figure 20E:
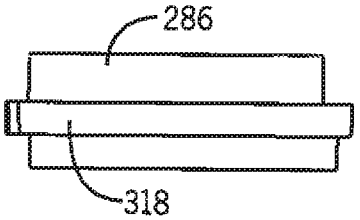
FIG. 20E is a side elevation view of the insert of FIG. 20A.
Figure 20F:
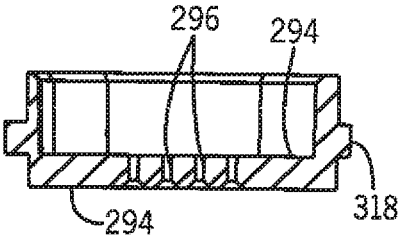
FIG. 20F is a section view taken along line 20E-20F of FIG. 20C.

Referring to FIGS. 16-18, connector housing 260 includes structure by which either upstream connector insert 262 or downstream connector insert 280 can be secured to connector housing 260. In this regard, a number of teeth 306 are located in the inner area of passage 276. Teeth 306 define inwardly facing ramped surfaces 308. A peripheral shoulder 310 extends into passage 276 at the proximal area of connector housing 260 located toward flange 266. A pair of alignment notches 312, which are located at 90 degrees to each other, extend inwardly from shoulder 310. An inner wall 311 extends inwardly from shoulder 310. Inner wall 311 is oriented parallel to the inner surface 277 of connector housing sidewall 275, and extends between shoulder 310 and an annular seating surface 313.

Upstream connector insert 262 includes a peripheral outer ridge 314. A pair of alignment bosses 316, which are located at 90 degrees to each other, extend outwardly from outer ridge 314. Similarly, downstream connector insert 280 includes a peripheral outer ridge 318. A pair of alignment bosses 320, located at 90 degrees to each other, extend outwardly from outer ridge 318.

As can be appreciated, upstream connector insert 262 and downstream connector insert 280 are similarly constructed, with the difference between the two being the location of notch 292 opposite flat 288 in upstream connector insert 262 and the location of notch 304 at 90° to flat 300 in downstream connector insert 280. Accordingly, upstream connector insert 262 and downstream connector insert 280 are secured to connector housing 260 in a similar manner. The combination of upstream connector insert 262 with connector housing 260 forms upstream connector 232, and the combination of downstream connector insert 280 with connector housing 260 forms downstream connector 234.

The engagement of upstream connector insert 262 with connector housing 260 will be explained, with the understanding that this explanation applies equally to engagement of downstream connector insert 280 with connector housing 260.

Figure 21:
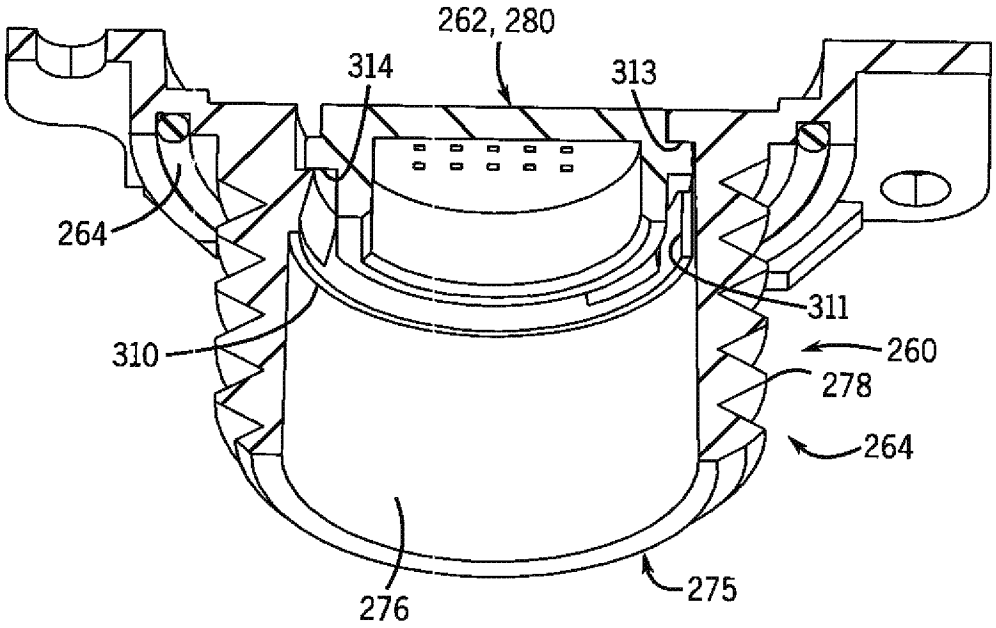
FIG. 21 is a section view of an assembled cable connector, which may representatively be either the upstream cable connector of FIG. 16 or the downstream cable connector of FIG. 17.

To secure upstream connector insert 262 with connector housing 260, upstream connector insert 262 is positioned such that the alignment bosses 316 are in alignment with the alignment notches 312 that extend inwardly from the shoulder 310 in the passage 276 of connector housing 260. Upstream connector insert 262 is then inserted into passage 276, such that alignment bosses 320 are moved into alignment notches 312. The outside diameter of the peripheral ridge 318 is slightly smaller than the inside diameter defined by shoulder 310 and side wall 311, which enables upstream connector insert 262 to be moved past shoulder 310. As upstream connector insert 262 is moved past shoulder 310, the outer ridge 314 of upstream connector insert 262 comes into contact with the ramped surfaces 308 of teeth 306. Continued advancement of upstream connector insert 262 moves ridge 314 along the ramped surfaces 308 of teeth 306. When ridge 314 moves past the inner extent of ramped surfaces 308, the engagement edges of teeth 306 are positioned over ridge 314, to thereby prevent outward movement of upstream connector insert 262. Upstream connector insert 262 is moved inwardly until the inner edge of ridge 314 comes into contact with seating surface 313. The thickness of ridge 314 is such that the inner edge of ridge 314 engages seating surface 313 immediately after teeth 306 snap over ridge 314, to firmly capture upstream connector insert 262 and secure upstream connector insert 262 to connector housing 260. Alignment bosses 316 and alignment notches 312 function to ensure that upstream connector insert 262 is secured to connector housing 260 in a predetermined orientation. Similarly, alignment bosses 320 cooperate with alignment notches 312 to ensure that downstream connector insert 280 is secured to connector housing 260 in a predetermined orientation. FIG. 21 illustrates upstream connector insert 262/downstream connector insert 280 fully engaged with connector housing 260.

Figure 22:
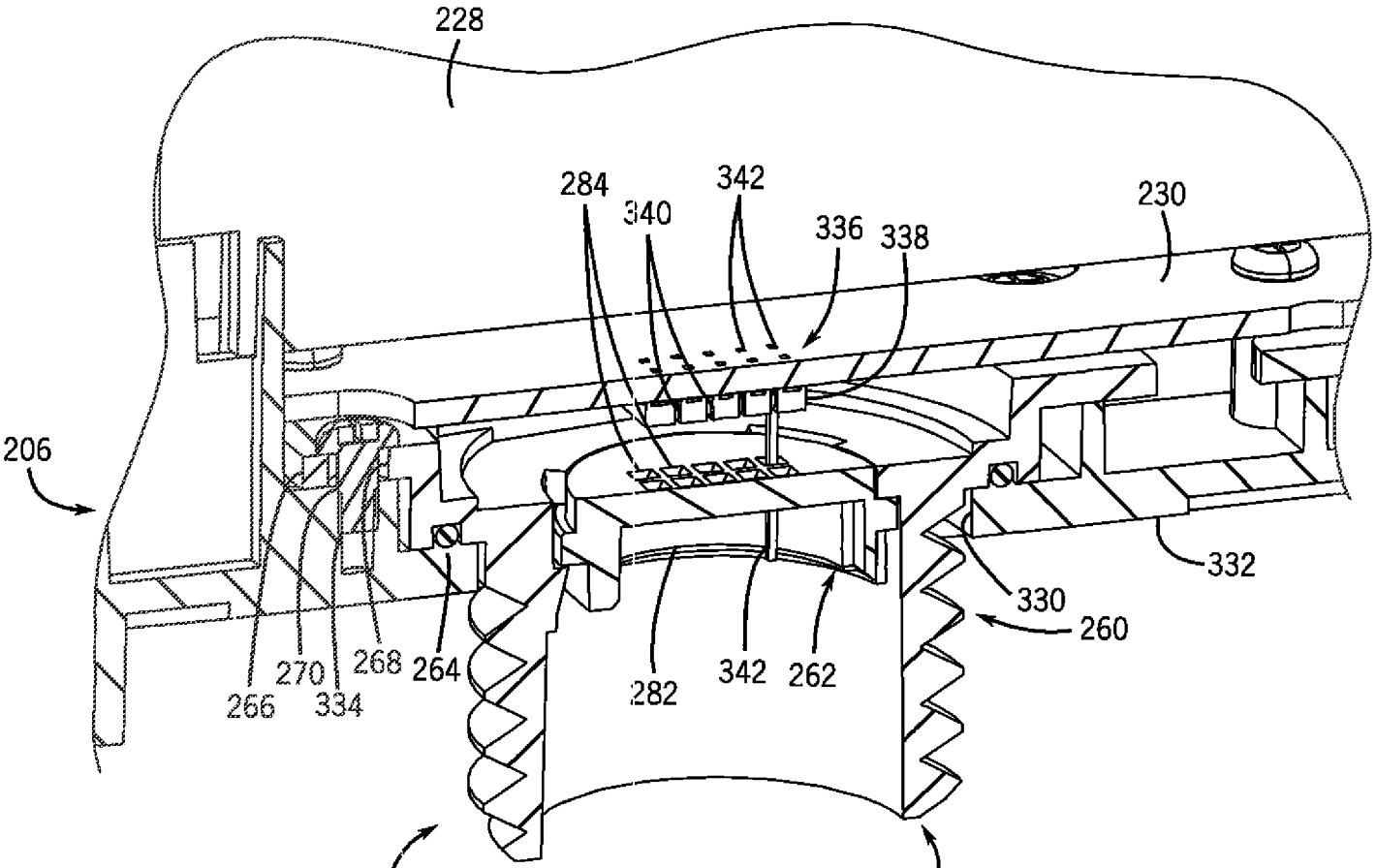
FIG. 22 is a partial isometric section view illustrating a portion of the sensor of FIG. 5 and connection of one of the cable connectors, in this ease the upstream cable connector of FIG. 16 to the sensor.
Figure 23C:
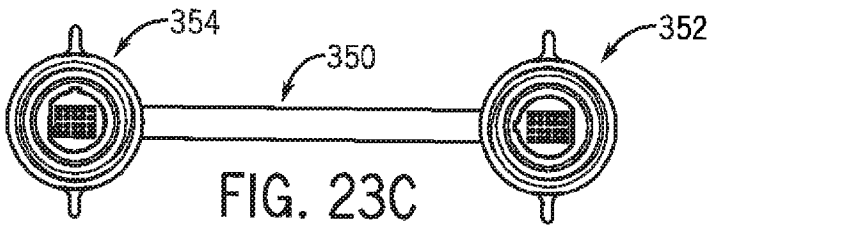
FIG. 23C is a top plan view of the connector cable of FIG. 23A.
Figure 23D:
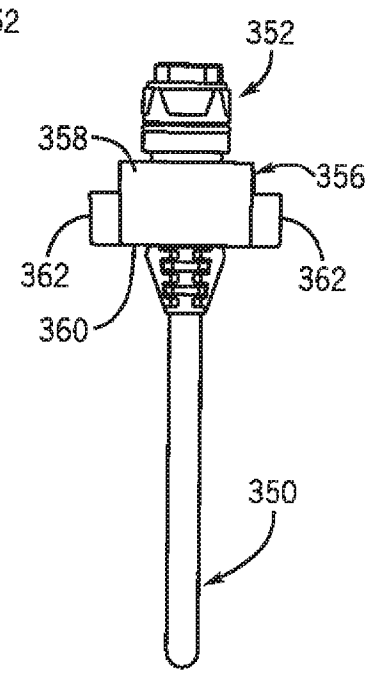
FIG. 23D is a side elevation view of the connector cable of FIG. 23A.
Figure 23B:
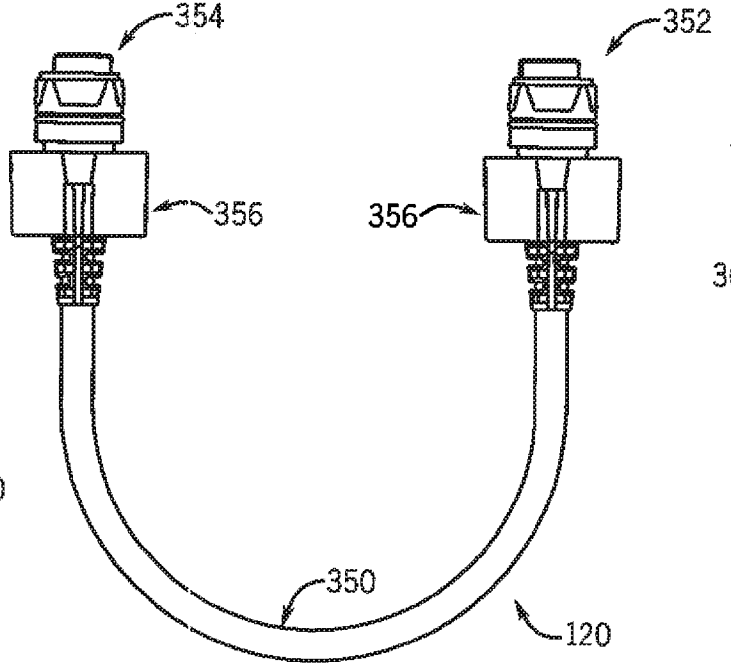
FIG. 23B is a front elevation view of the connector cable of FIG. 23A.
Figure 23A:
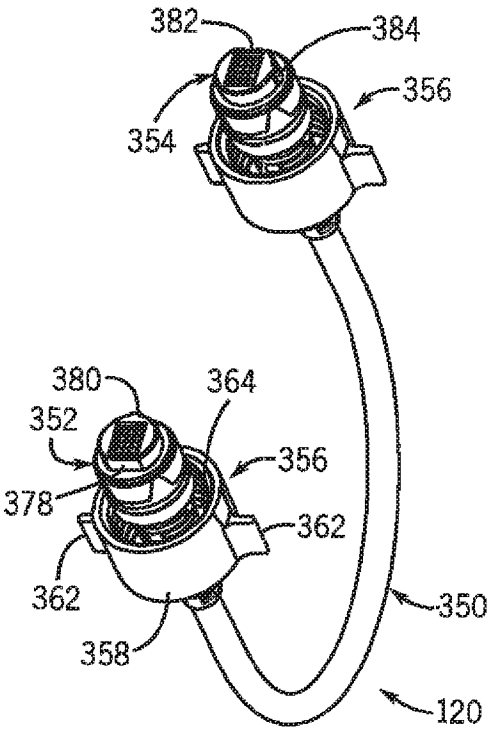
FIG. 23A is an isometric view of one of the connector cables incorporated in the security system of FIG. 1.

FIG. 22 illustrates the assembly of upstream connector 232 to node 118. Connector housing 260 is inserted into the interior of lower section 206 of node housing 202, such that the threaded body portion 274 of connector housing 260 extends through an opening 330 formed in a lower wall 332 defined by lower section 206. The O-ring 264 contacts the inner surface of lower wall 332 so as to seal around the opening 330. Screws 270 extend through openings 268 in upper flange 266 ending to engagement with passages 334, to securely mount the connector 232 to the lower wall 332 of lower section 206 of node housing 202. While FIG. 22 illustrates the assembly of upstream connector 232 to node 118, it is understood that downstream connector 234 is secured to node 118 in a similar manner.

As also shown in FIG. 22, the lower PCB 230 is positioned at the lower end of the interior of lower section 206 of node housing 202. Lower PCB 230 includes a pin-type upstream connection area 336. The upstream connection area 336 includes a pin mounting block 338 having a series of passages 340 in alignment with a series of pin engagement openings 342 in lower PCB 230. A series of PCB connection pins, one of which is shown at 342, are engaged within the pin engagement openings 340 in lower PCB 230. The pin mounting block 338 functions to securely connect the inner ends of pins 342 to lower PCB 230 and to provide structural rigidity to the pins 342. The pins 342 provide connections to the circuits of lower PCB 230, in a manner as is known. The number and locations of the pins 342 will vary according to the circuits of the lower PCB 230 to which the pins 342 are connected. The pin engagement openings 342 in lower PCB 230 and the passages 340 in pin mounting block 338 are arranged so as to match and align with the pin guide openings 284 in upstream connector insert 262. In this manner, the pin guide openings 284 maintain the pins 342 in position and ensure that the pins 342 remain parallel to each other. An outer engagement portion of each pin 342 extends past the pin guide wall 282 into the recess 290 of the upstream connector insert 262, to form the male portion or a multiple pin connection.

At the opposite end of node 118, the lower PCB 230 includes a similarly configured downstream connection area having a pin mounting block and pin engagement openings that are arranged to match and align with the pin guide openings 296 in downstream connector insert 280. Again, a series of pins 342 provide connections to the circuits of lower PCB 230, and the number and locations of the pins 342 vary according to the circuits of the lower PCB 230 to which the pins 342 are connected. Outer engagement portions of the pins 342 extend past the pin guide wall 294 into the recess 302 of the downstream connector insert 280, to form the male portion of a multiple pin connection.

Referring to FIG. 23, each connector cable 120 includes a cable 350 that extends between and interconnects an upstream connector 352 and a downstream connector 354. Each connector cable 120 further includes a pair of retainers in the form of locking rings 356. Each locking ring 356 is generally cylindrical, including a side wall 358 and an end wall 360 having an opening through which cable 350 extends. A pair of finger tabs 362 extend outwardly from side wall 358. The inside surface of side wall 358 includes a series of threads 364, which match the threads 278 on body portion 274 of connector housing 260. In this manner, the locking ring 356 can be threadedly engaged with the connector housing 260. Each locking ring 356 defines an internal cavity or recess that is sized so as to enclose its associated connector 352, 354 when the connector 352, 354 is engaged with the respective upstream connector 232 or downstream connector 234.

Figure 24:
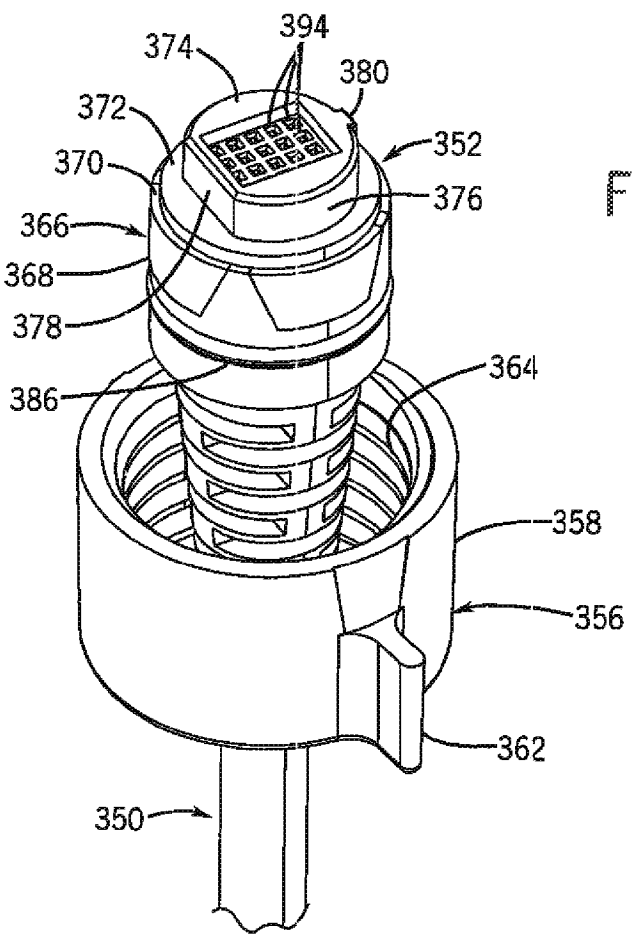
FIG. 24 is a partial isometric view of one end of the connector cable of FIG. 23, which may representatively be the upstream end.

FIG. 24 illustrates upstream connector 352 in detail, and it is understood that downstream connector 354 is similarly constructed. As shown, upstream connector 352 includes a connector head 366 having a side wall 368 terminating in a shoulder 370. Connector head 366 further includes an annular stop surface 372, and terminates in an outer face 374. A side wall 376 extends between stop surface 372 and outer face 374. Side wall 376 is formed at so as to include a flat 378 and a diametrically opposite key 380. Downstream connector 354 has a similar construction. However, as shown in FIG. 23, downstream connector 354 has a flat 382 and a key 384 that arc at 90° to each other. With this construction, it can be appreciated that the end of upstream connector 352 has a configuration that matches that of the recess 290 in upstream connector insert 262, wherein flat 288 and notched 292 are diametrically opposite each other. Similarly, the end of downstream connector 354 has a configuration that matches that of the recess 302 in downstream connector insert 280, wherein flat 300 and notch 304 are at 90° to each other.

Figure 25:
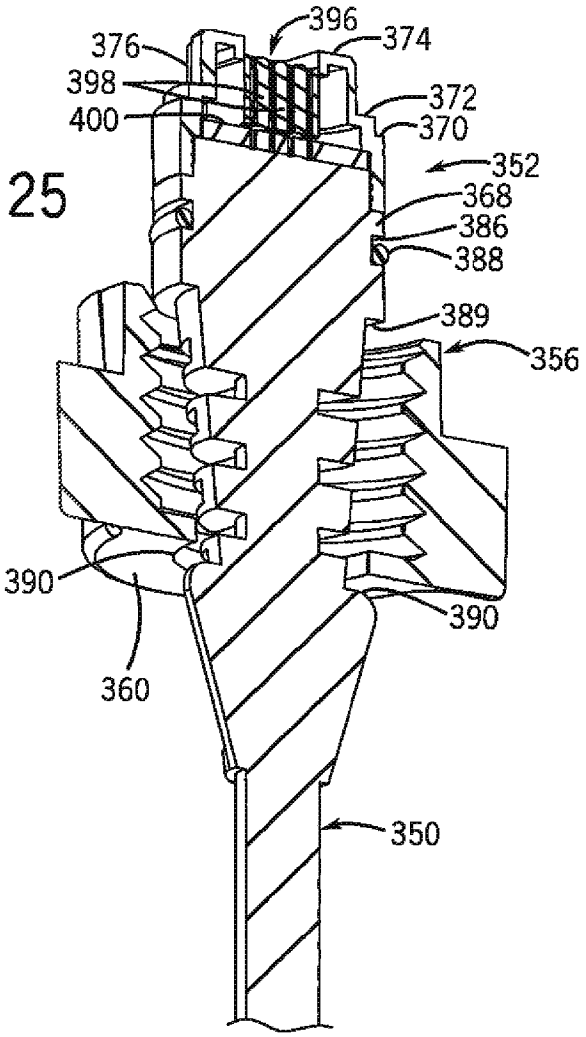
FIG. 25 is a partial longitudinal cross section of the end of the connector cable as shown in FIG. 24.

FIG. 25 illustrates a cross-section of upstream connector 352. Again, downstream connector 354 is similarly constructed, and the following description applies equally to both upstream connector 352 and downstream connector 354. As shown in FIG. 25, side wall 368 includes an annular groove within 386 within which an O-ring 388 is received. At a location spaced from groove 386, upstream connector 352 includes an annular engagement surface 389, which faces in a direction opposite that of stop surface 372. Upstream connector 352 further includes a pair of wings 390, which define a transverse dimension greater than that of the opening in end wall 360 of locking ring 356 so as to maintain locking ring 356 at a location adjacent upstream connector 352.

The outer face 374 of upstream connector 352 includes a series of pin guide openings 394, which are arranged in a pattern that matches that of pin guide openings 284 in pin guide wall 282 of upstream connector insert 262. A female multiple pin receiver 396 is positioned within connector head 366. The female pin receiver 396 includes a series of contacts 398 that extend outwardly from a base 400. The contacts 398 define a series of passages or sockets that are in alignment with the pin guide openings 394. The contacts 398 are connected to wires or conductors (not shown) that are encased within the body of connector head 366 and that extend through cable 350. The wires or conductors are connected to a like a set of contacts associated with downstream connector 354 at the opposite end of cable 350, so that the contacts at the opposite ends of the cable 350 are electrically connected together.

In the illustrated embodiment, the upstream connector head 366 is in the form of a cap that is secured over the base 410 and the multiple pin receiver 396, such as by overmolding. It is understood, however, that the upstream connector and cable may have any satisfactory construction that presents an outwardly facing multiple pin receiver.

Figure 26:
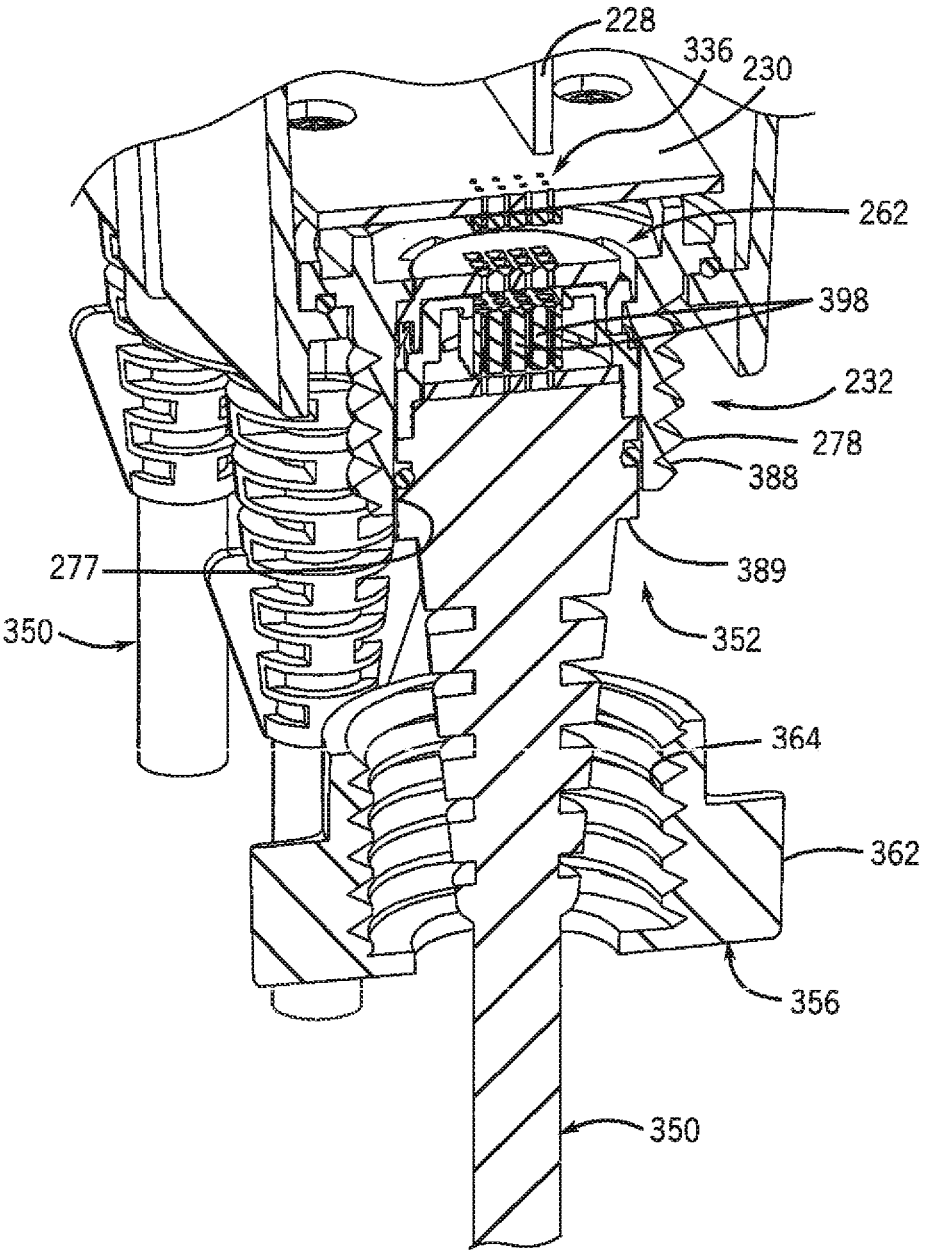
FIG. 26 is a partial section view illustrating engagement of the end of the connector cable as in FIG. 24 with the cable connector as in FIG. 16.

FIG. 26 illustrates the manner in which upstream cable connector 352 is engaged with upstream node connector 232, with the understanding that downstream cable connector 354 is engaged with downstream node connector 234 in a similar manner. First, the user inserts upstream cable connector head 366 into passage 276 of connector housing 260, making sure that flat 378 and key 380 are aligned with flat 288 and notch 292 of upstream connector insert 262. The user then advances connector head 366 inwardly, so that face 374 is moved toward pin guide wall 282. During such inward movement of connector head 366, the outer engagement portions of the pins 342 move through the pin guide openings 394 in the face 374 and into engagement with the passages or sockets defined by the contacts 398. In this manner, the pins 342 and contacts 398 establish an electrical connection between lower PCB 230 and the wires or conductors contained within the cable 350, which in turn functions to connect the lower PCB 230 of one node 118 to the lower PCB 230 of the adjacent node 118. As connector head 366 is advanced, stop surface 372 is moved into contact with the outer edge 287 of sidewall 286 of upstream connector insert 262. Sidewall 376 of connector head 366 as a depth less than that of connector insert sidewall 286, which ensures that advancement of connector head 366 is stopped before face 374 comes into contact with pin guide wall 294.

When upstream cable connector head 366 is advanced into passage 276 of connector housing 260, O-ring 388 contacts the inner surface 277 of the connector housings sidewall 275, to establish a weather-tight seal that prevents the entry of moisture, dust and other contaminants to the interface between pins 342 and contacts 398.

Figure 28:
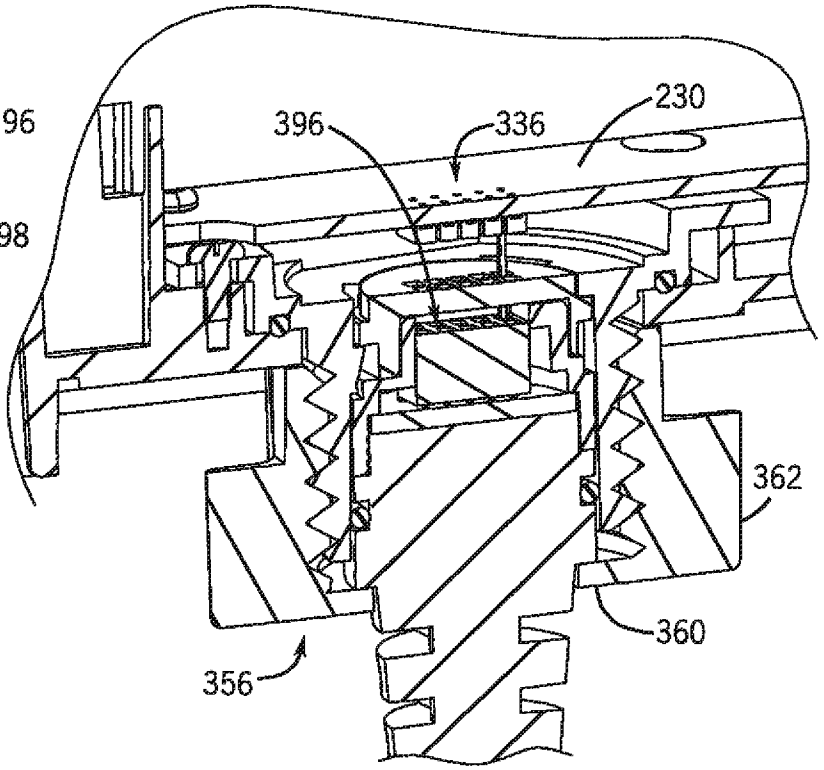
FIGS. 27 and 28 are partial section views similar to FIG. 26, showing engagement of the end of the connector cable as in FIG. 24 with the cable connector as in FIG. 16.
Figure 27:
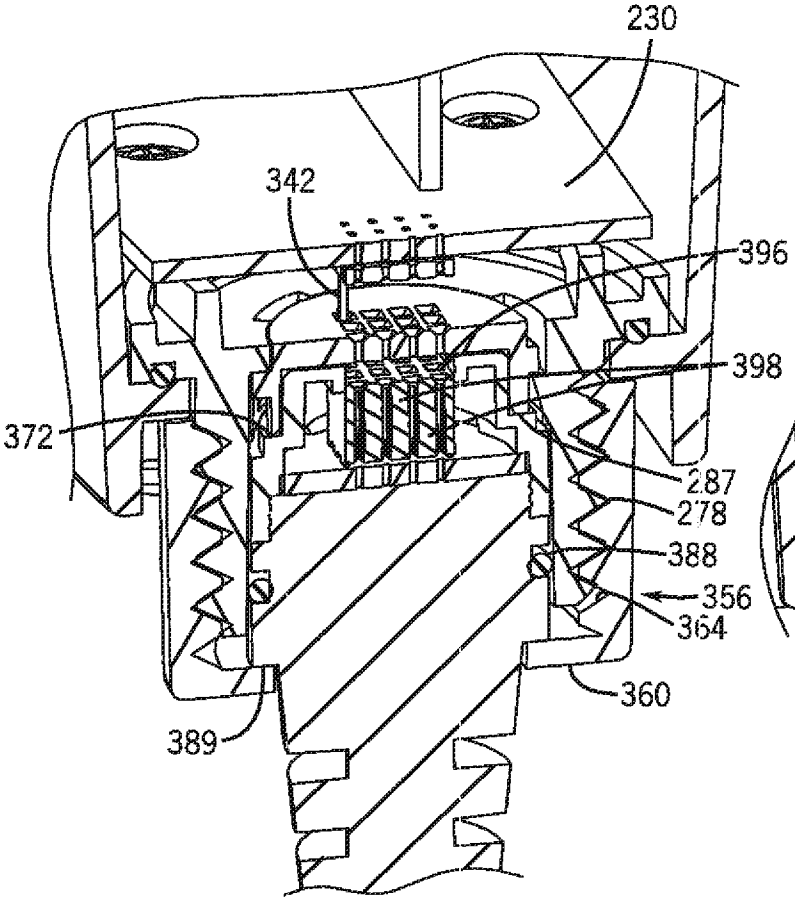

As shown in FIGS. 27 and 28, the user then advances locking ring 356 toward the body portion 274 of connector housing 260, and engages the internal threads 364 of locking ring 356 with the external threads 278 of connector housing 260. The user then rotates locking ring 356 so as to advance locking ring 356 on body portion 264 of connector housing 260. As locking ring 356 is advanced, the inner surface of end wall 360 comes into contact with engagement surface 389 of connector head 366. In combination with engagement of stop surface 372 with outer edge 287 of connector insert sidewall 286, this functions to securely clamp upstream cable connector 352 to upstream node connector 232.

The drawings and description relate to a connection arrangement in which pins 342 are secured to lower PCB 230, and are thereby stationary, and the female pin receiver 396 is carried by connector head 366. It contemplated, however that this configuration could be reversed in that the pins 342 may be secured to and carried by connector head 366 and the female pin receiver 396 may be secured to lower PCB 230.

Figure 9:
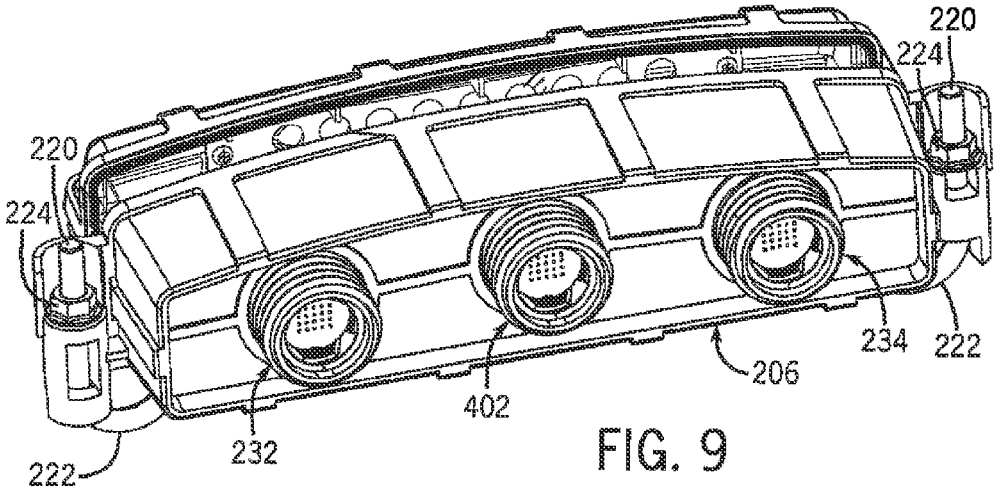
FIG. 9 is a bottom front isometric view somewhat similar to the view of FIG. 6, showing the cable connectors removed.
Figure 10:
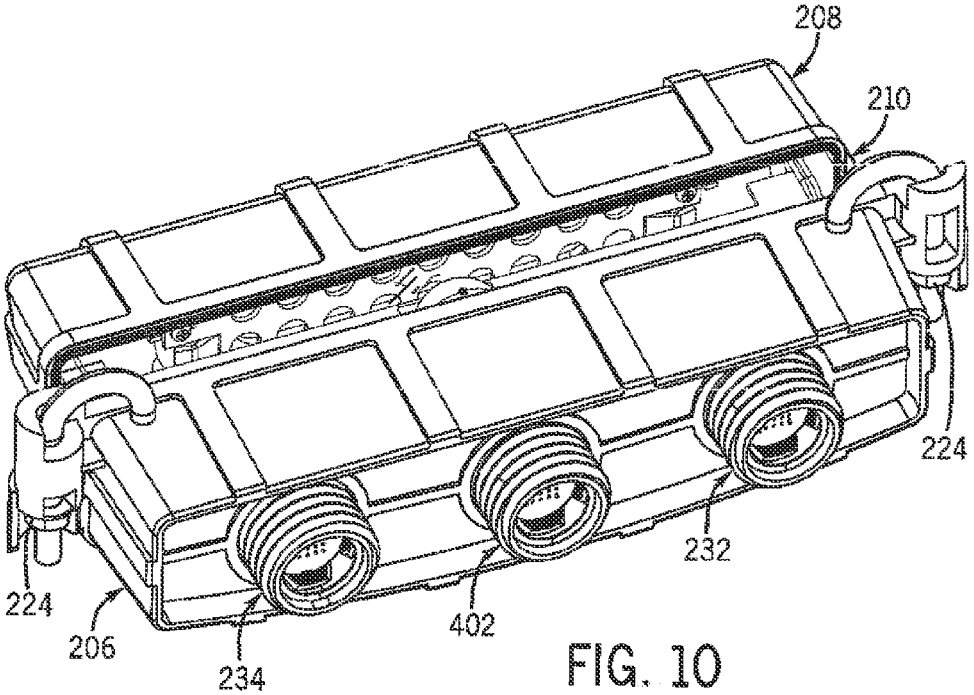
FIG. 10 is a bottom rear isometric somewhat similar to the view of FIG. 8, showing the cable connectors removed.

Referring to FIGS. 9-11, the illustrated embodiment shows an optional auxiliary connector 402 located between upstream connector 232 and downstream connector 234. The optional auxiliary connector 402 is constructed similarly to upstream connector 232 and downstream connector 234, and may be used to mount auxiliary equipment, such as a still camera, video camera, sound recorder, speaker, etc. to the node 118. Alternatively, if auxiliary connector 402 is unused, it may be capped off and sealed to prevent the entry of moisture or other contaminants into the interior of the node housing.

Figure 29:
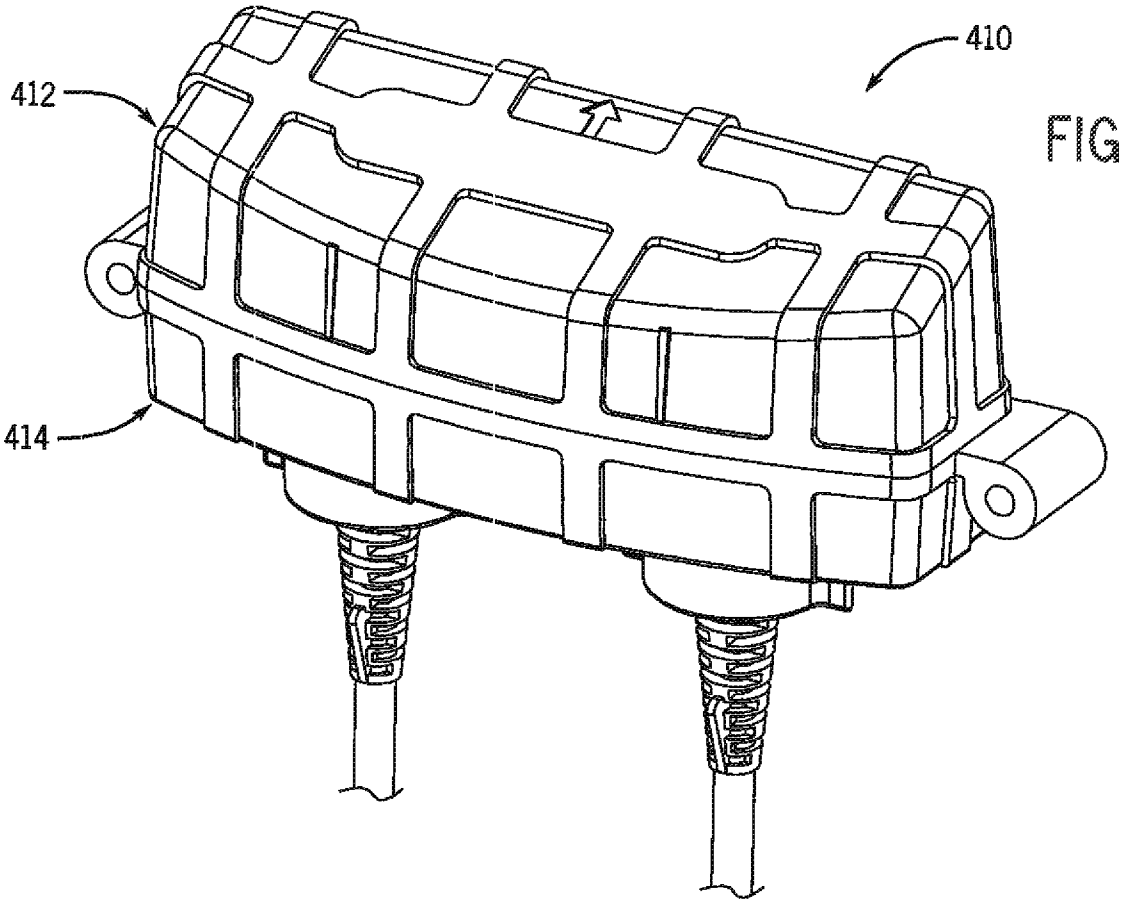
FIG. 29 is an isometric view similar to FIG. 5, showing an alternative embodiment of a sensor for use in the security system of FIG. 1.

FIG. 29 illustrates an alternative node housing 410 in accordance with the present invention. In this embodiment, the auxiliary connector 402 is eliminated, which may be the case if the auxiliary components are contained within the interior of the node housing 410. In this embodiment, the node housing 410 is formed of an upper housing section 412 and a lower housing section 414, without the presence of an intermediate section such as 210 between the upper and lower housing sections. If desired, both of the housing sections 412, 414 may be made of an opaque material. An embodiment such as this is satisfactory if light-sensitive components, such as passive infrared sensors or LEDs, are not incorporated into the node. However, if light-sensitive components are to be incorporated into a node with a housing 410, one or both of the housing sections 412, 414 may be formed of a transparent or translucent material. Alternatively, node housing 410 may be constructed such that the light-sensitive components are fitted within recesses formed in the walls of the housing sections 412, 414 at the joint between the wall sections 412, 414, or within openings in one or both of the housing sections 412, 414. Still further, the light-sensitive components contained within the node housing 410 may be exposed to the exterior of node housing 410 through windows or other light-transmissive structure associated with one of both of housing sections 412, 414.

Figure 12:
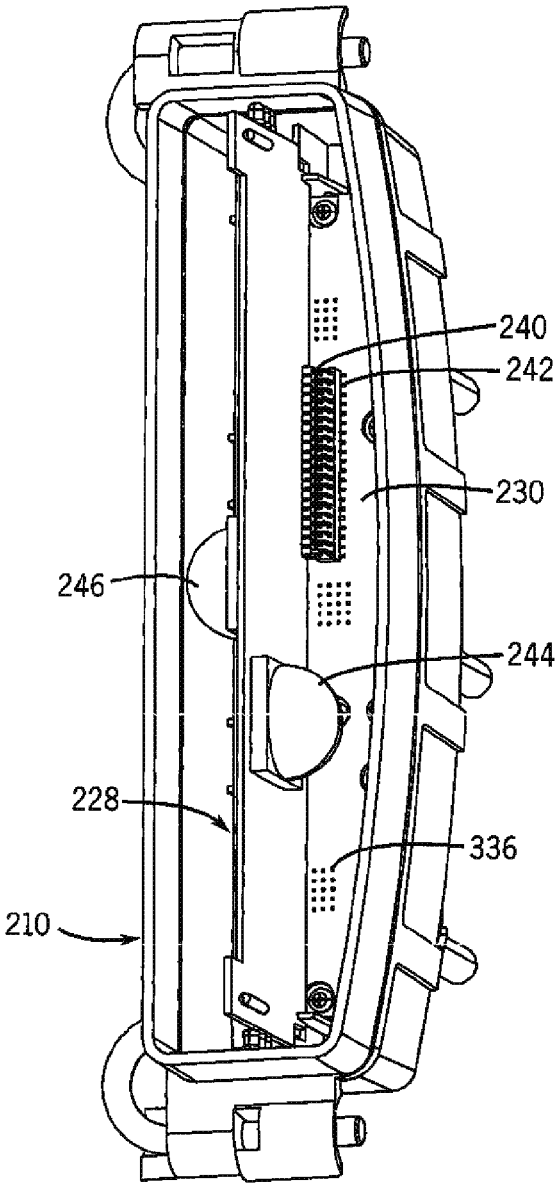
FIG. 12 is a partial front isometric view showing the interior of the bottom portion of the sensor of FIG. 5.
Figure 13:
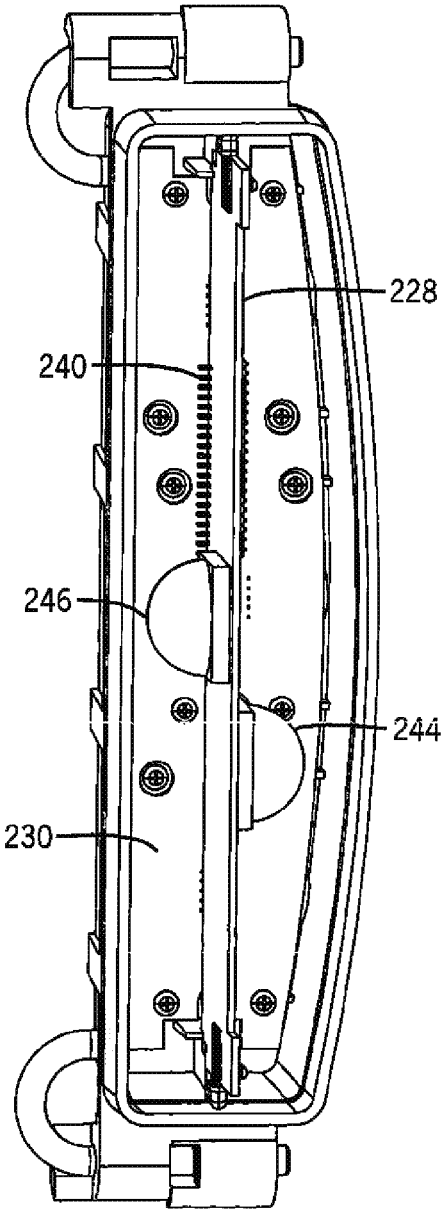
FIG. 13 is a partial rear isometric view showing the interior of the bottom portion of the sensor of FIG. 5.
Figure 14:
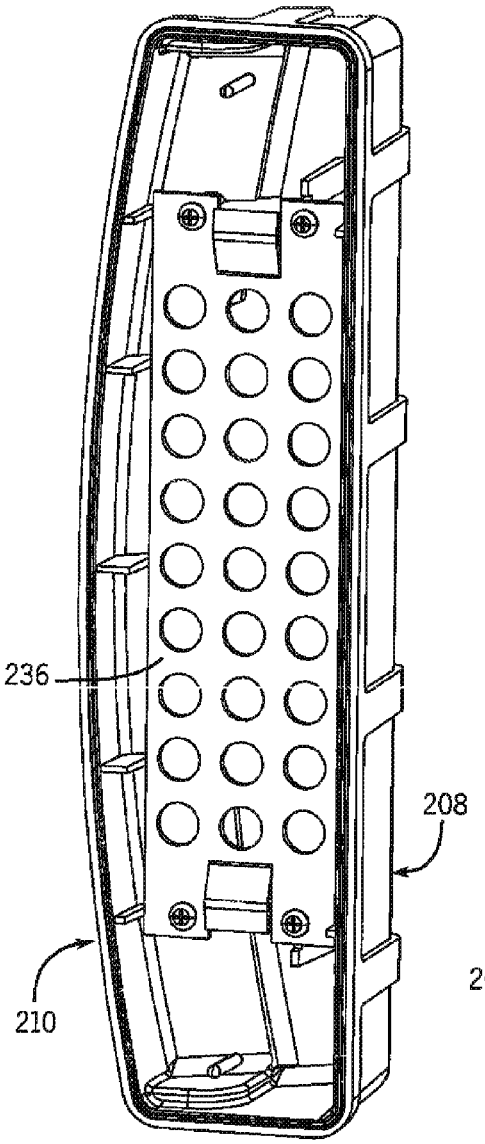
FIG. 14 is a partial isometric view showing the interior of the top portion of the sensor of FIG. 5.
Figure 15:
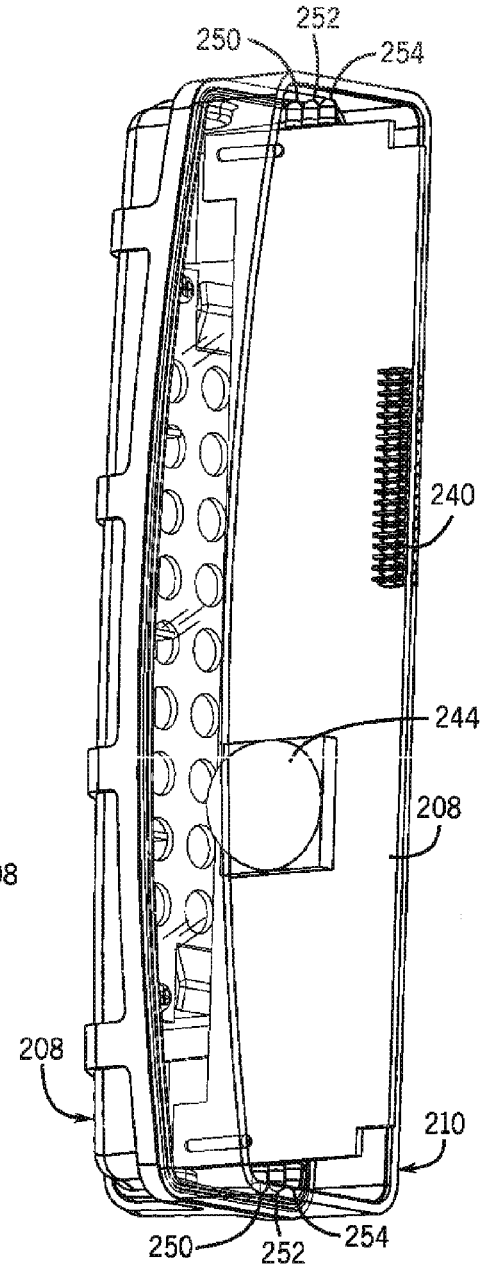
FIG. 15 is a partial isometric view showing the top portion of the sensor of FIG. 5 in combination with a circuit board, which is illustrated in FIGS. 12 and 13 in the interior of the bottom portion of the sensor.
Figure 30:
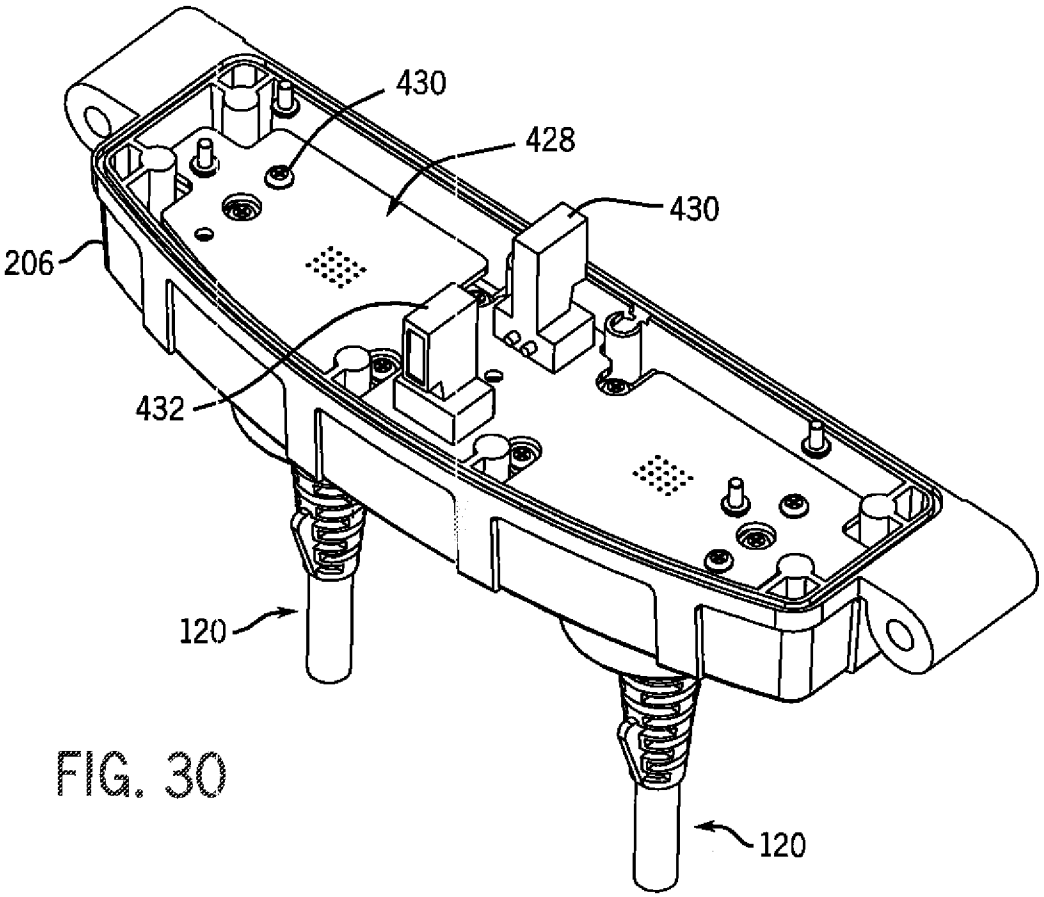
FIG. 30 is an isometric view of an alternative embodiment of a circuit board assembly adapted for use in the sensor of FIGS. 5 and 28.

FIG. 30 shows an alternative embodiment of a circuit board arrangement that may be used in the node, such as 118, 410, in place of the vertical PCB 228 and horizontal PCB 230 as shown, e.g. in FIGS. 11-13, and as discussed previously. In this embodiment, a one-piece PCB 428 is mounted within the interior of lower housing section 206 in any satisfactory manner, such as by screws 430 that extend through openings in PCB 428 into engagement with upstanding mounting bosses associated with lower housing section 206. It is understood, however, that any other satisfactory mounting arrangement may be employed. In this embodiment, the infrared sensors, shown at 430, 432, are configured so as to be mounted to the horizontal PCB 428 and to extend upwardly therefrom. With this arrangement, the two-piece PCB and associated connections are eliminated and replaced with a single PCB with all of the electronic components of the node such as 118, 410.

Figure 31:
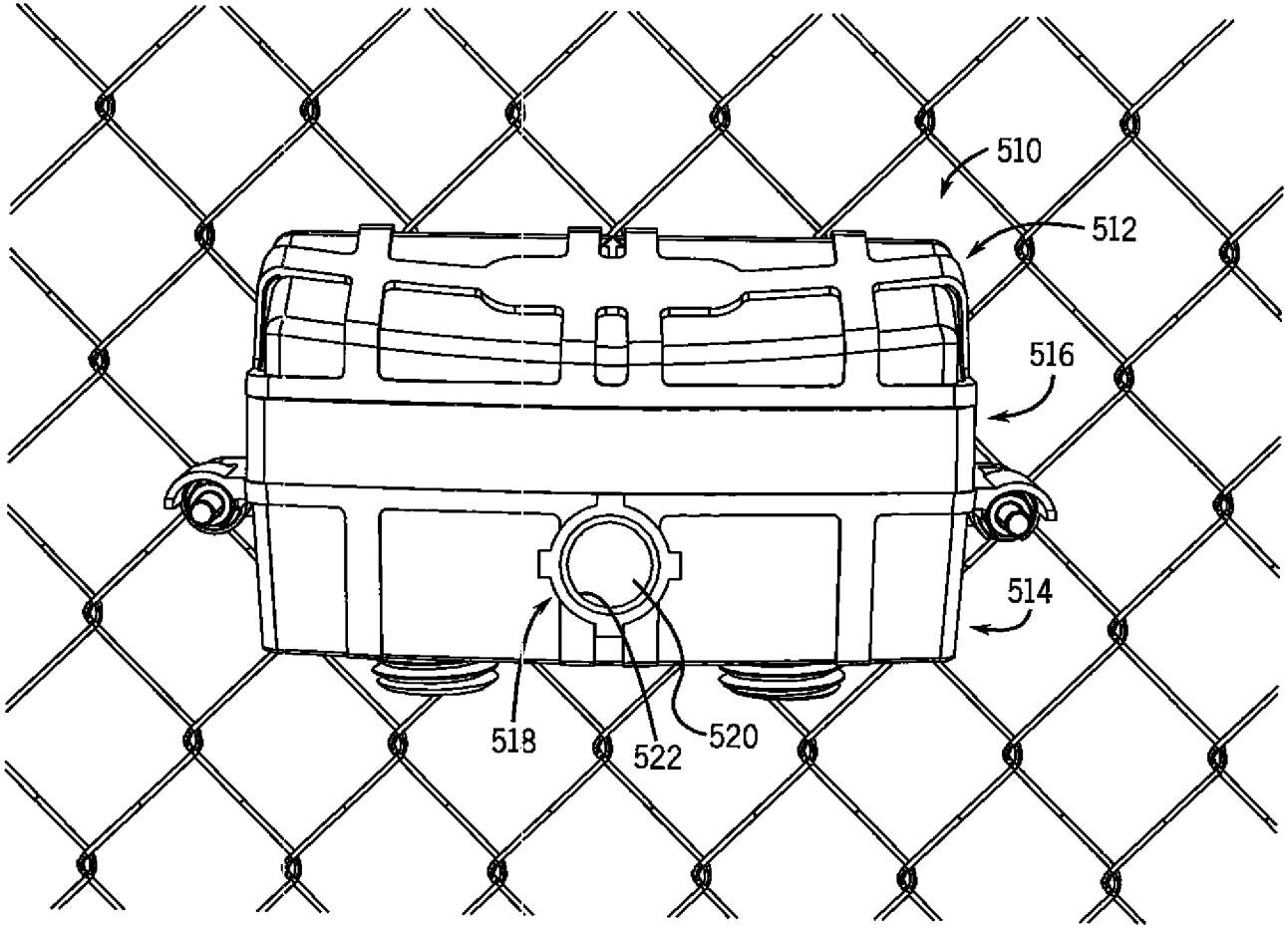
FIG. 31 is an isometric view of an alternative embodiment of a sensor for use in the security system of FIG. 1.

FIG. 31 illustrates an alternative node housing 510 in accordance with the present invention. In this embodiment, the auxiliary connector such as 402 is eliminated, which may be the case if the auxiliary components are contained within the interior of the node housing 510. In this embodiment, the node housing 510 is formed of an upper housing section 512 and a lower housing section 514, with an intermediate section such as 516 located between the upper and lower housing sections 512, 514, respectively. It is understood, however, that housing 510 may also be constructed without the intermediate section 516 as shown in FIG. 29, if desired. Node housing 510 includes a camera shown generally at 518. Camera 518 has a lens 520, which is exposed to the exterior of housing 510 through an opening 522 that is formed in the front wall of lower housing section 514. As can be appreciated, the interface between opening 522 and camera lens 520 is fitted with appropriate seals or the like so as to prevent dust, moisture or other contaminants from entering the interior of housing 510. Camera 518 may be any satisfactory CCTV or IP camera, and is preferably mounted to the board within the interior of housing 510, such as a board such as shown at 248 in FIG. 11. Representatively, the camera 518 may be a camera such as is available from Pixim, Inc. under its model number D8800C Seawolf Digital Imaging System, although it is understood that any other satisfactory camera may be employed.

Figure 32:
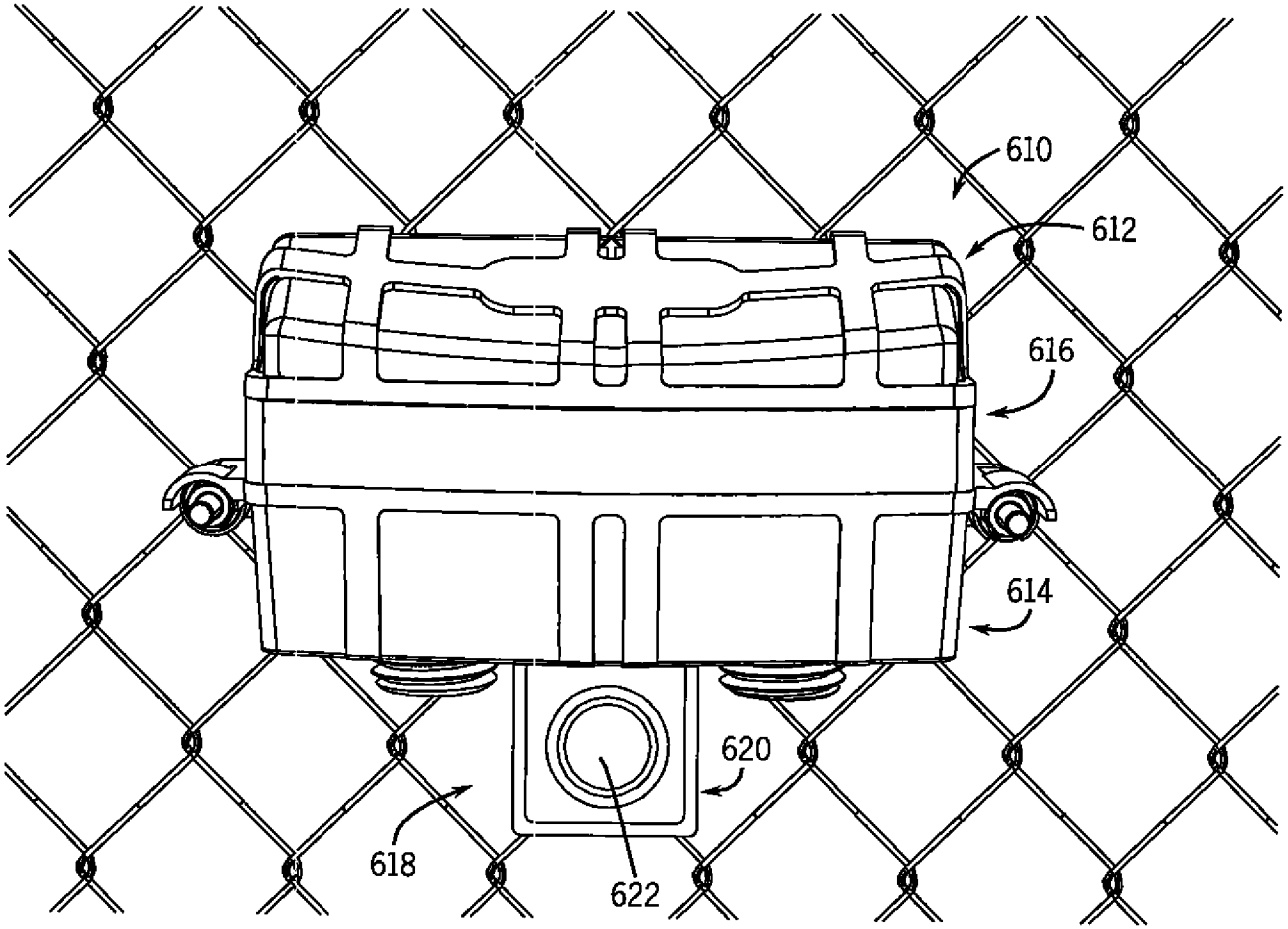
FIG. 32 is an isometric view of another alternative embodiment of a sensor for use in the security system of FIG. 1.
Figure 33:
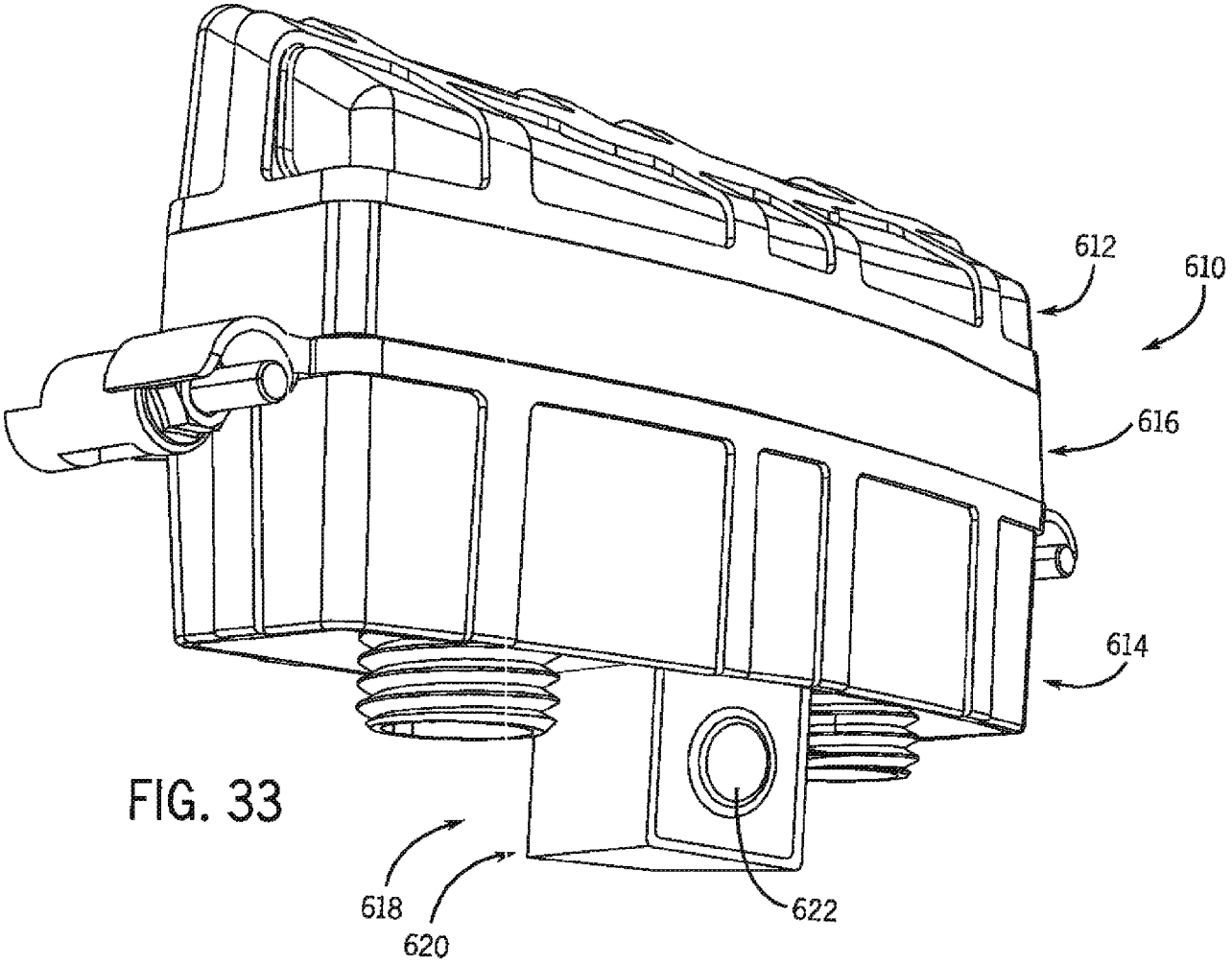
FIG. 33 is a bottom isometric view of the sensor of FIG. 32.

FIGS. 32 and 33 illustrate an alternative node housing 610 in accordance with the present invention. In this embodiment, the node housing 610 is formed of an upper housing section 612 and a lower housing section 614, with an intermediate housing section 616 located between the upper and lower housing sections 612, 614, respectively. It is understood, however, that housing 610 may also be constructed without the intermediate section 616 as shown in FIG. 29, if desired. In this version, node housing 610 is provided with an external camera attachment 618. The camera attachment 618 includes a camera housing 620 that is secured to the bottom wall of lower section 614 of node housing 610. Camera 618 further includes a lens 622 that is exposed to the exterior of camera housing 620. Appropriate connections are made between camera 618 and the board within the interior of node housing 610, such as board 248 in FIG. 11. Again, camera 618 may be any satisfactory CCTV or IP camera. Representatively, the camera 618 may be a camera, such as is available from Pegasus Products under its model number PCCMINI-WDR, although it is understood that any other satisfactory camera may be employed. In this version, the camera 618 may be mounted to an adapter or the like formed in lower housing section 614, without the requirement for a modification to the lower housing section as in the embodiment of FIG. 30. The camera 618 may be a pan-tilt-zoom camera that provides a wide range of viewing options.

The cameras such as 518, 618 are powered by and interconnected with the cables 120 for communicating the camera signals to the central security station 112. The cameras 518, 618 provide real-time video monitoring capability for the perimeter security system. Typically, the cameras 518, 618 are provided only at certain locations along the length of the perimeter security system since one camera is able to monitor a number of fence sections. Representatively, the cameras 518, 618 may be ethernet-connected IP video cameras that transmit signals digitally. In an application such as this, the cameras 518, 618 can be controlled to accomplish various functions, such as decreased frame rate, image resolution, etc. If an event is detected, the camera can be controlled so as to increase picture quality, frame rate, resolution, etc. and to alert adjacent nodes to do the same. Alternatively, wavelength division multiplexing may be used to process the output of the cameras 518, 618. This enables the analog camera outputs to be converted to waves and then multiplexed along single fibers, which allows the camera signals to be transmitted to the controller.

Figure 34:
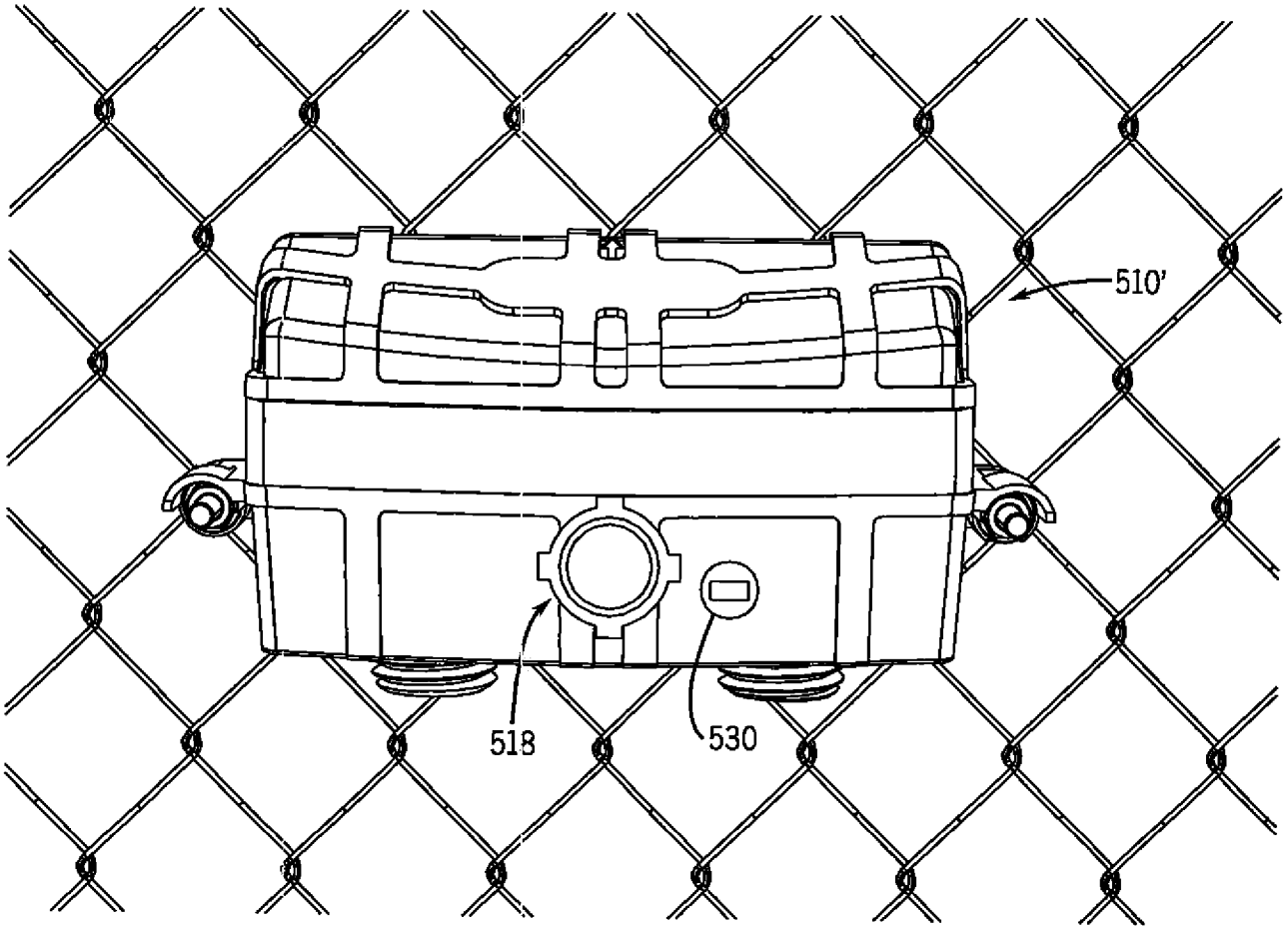
FIG. 34 is an isometric view of another alternative embodiment of a sensor for use in the security system of FIG. 1.
Figure 35:
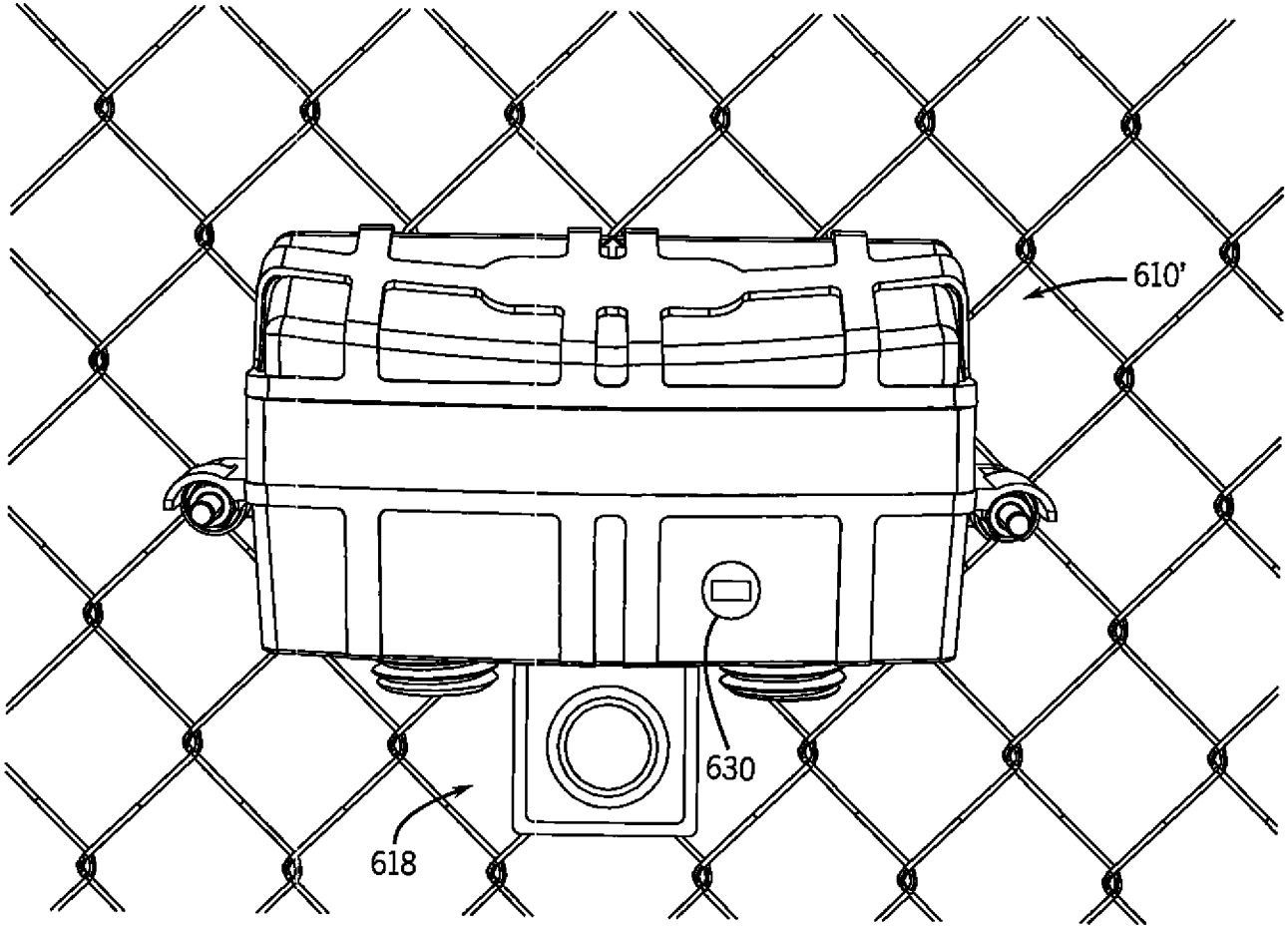
FIG. 35 is an isometric view of another alternative embodiment of a sensor for use in the security system of FIG. 1.
Figure 36:
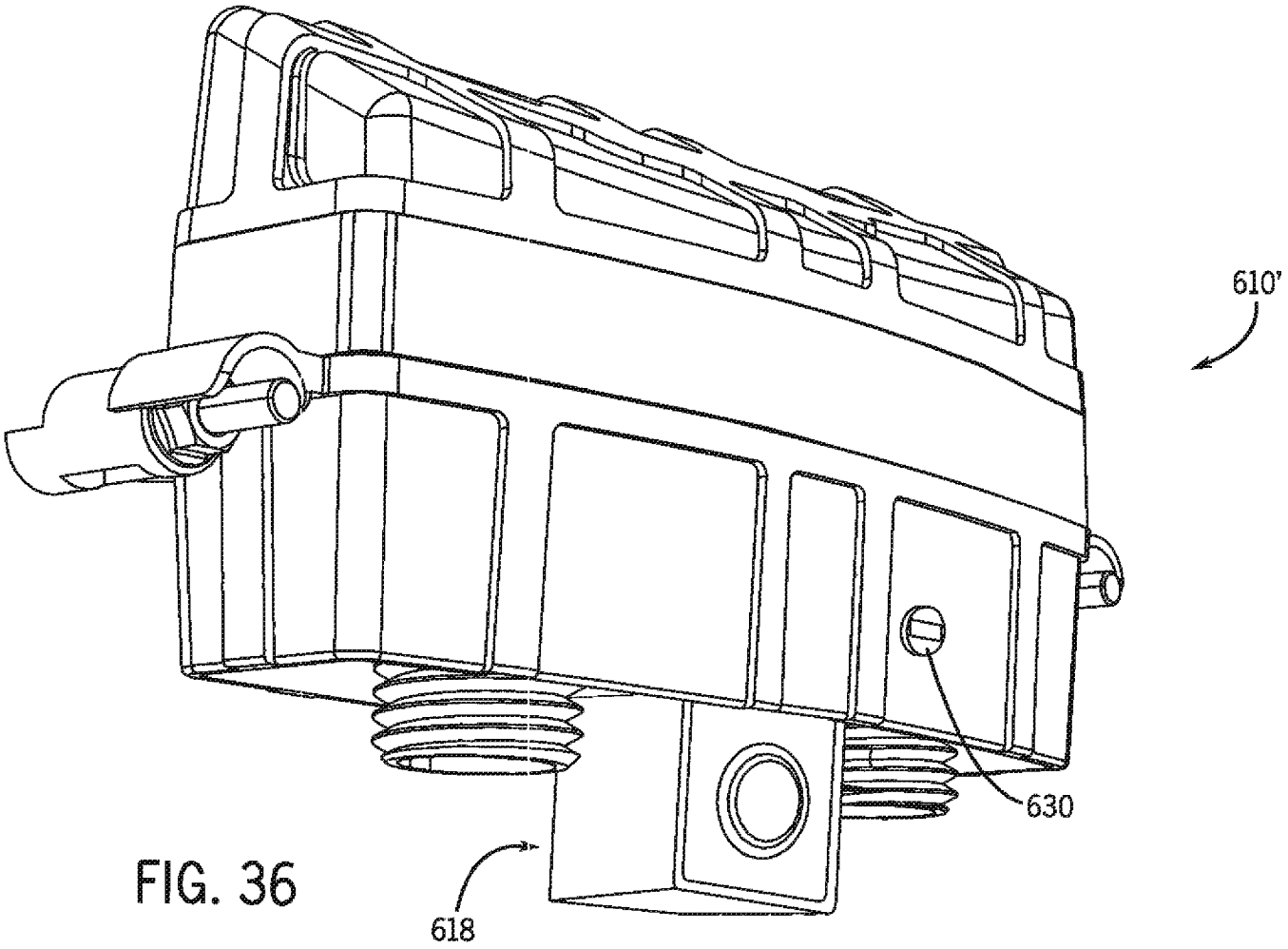
FIG. 36 is a bottom isometric view of the sensor of FIG. 34.

FIG. 34 illustrates a node housing 510', which is similar to node housing 510 as shown in FIG. 31 and described above. Node housing 510' includes a camera 518, but differs from node housing 510 in that it includes a source of external illumination. In the illustrated embodiment, the source of external illumination is an LED 530, which is mounted to the wall of the lower housing section and is connected to the board contained within the interior of node housing 510'. The LED 530 may be configured to be constantly illuminated, or alternatively may be illuminated in response to detection of motion in the vicinity of node housing 510'. The LED 530 may also be controlled by a photocell or time controller, if desired. FIGS. 35 and 36 illustrate a node housing 610', which is similar to node housing 610, as shown in FIGS. 31 and 32 and described above. Node housing 610' includes a camera 618, and again differs from node housing 610, in that it includes a source of external illumination. As before, in the illustrated embodiment, the source of external illumination is an LED 630, which is mounted to the wall of the lower housing section and is connected to the board contained within the interior of node housing 610'. Again, the LED 630 may be configured to be constantly illuminated, or alternatively may be illuminated in response to detection of motion in the vicinity of node housing 610'. The LED 630 may also be controlled by a photocell or time controller, if desired.

While the sources of light in both embodiments are shown and described as an LED, it is understood that any other satisfactory light source may be employed.

Various alternatives and embodiments are contemplated as being within the scope of the following claims particularly pointing out and distinctly claiming the subject matter regarded as the invention.

I claim:

1. A perimeter security system, comprising:

a barrier; and a series of sensors secured to the barrier at spaced locations along the length of the barrier, wherein at least one of the sensors includes a detector for sensing the presence of a person or object in the vicinity of the sensor, and wherein the at least one sensor further includes a graduated sensory output responsive to the detector, wherein the graduated sensory output an output at the sensor that changes as the person or object approaches the detector.

2. The perimeter security system of claim 1, wherein the sensors are interconnected with a monitor at a location remote from the sensors.

3. The perimeter security system of claim 1, wherein the graduated sensory output comprises a visual alert.

4. The perimeter security system of claim 3, wherein the visual alert comprises a light emitting arrangement that changes color as the person or object approaches the detector.

5. The perimeter security system of claim 4, wherein the light emitting arrangement comprises a series of individual differently colored light emitting members that are progressively actuated as the person or object approaches the detector.

6. The perimeter security system of claim 5, wherein the individual differently colored light emitting members comprise a series of light emitting diodes.

7. The perimeter security system of claim 4, wherein each sensor includes a housing defining an interior within which one or more sensing components are contained, and wherein the light emitting arrangement is secured to a wall of the housing and is configured to be visible from an exterior of the housing.

8. The perimeter security system of claim 1, wherein the sensors are interconnected with a monitor at a location remote from the sensors, and wherein each sensor includes a housing defining an interior within which one or more sensing components are contained, and a series of connection cables that extend between and connect adjacent sensors to each other and that connect the sensors to the monitor.

9. The perimeter security system of claim 8, wherein each sensor includes first and second connectors, wherein one of the connection cables extends between the first connector and a connector associated with a first adjacent sensor, and wherein one of the connection cables extends between the second connector and a connector associated with a second adjacent sensor.

10. A method of operating a perimeter security system that includes a barrier in which a series of sensors are positioned on the barrier at spaced locations along the barrier, comprising sensing the presence of a person or object in the vicinity of at least one of the sensors by operation of a detector associated with the sensor, and operating a graduated sensory alert in response to the detector, wherein the graduated sensory alert is located on the at least one sensor and varies according to the distance of the person or object from the detector.

11. The method of claim 10, wherein the step of operating the graduated sensory alert is carried out by increasing the intensity of the sensory alert as the person or object approaches the detector.

12. The method of claim 10, further comprising the step of interconnecting the sensors with a monitor at a location remote from the sensors.

13. The method of claim 11, wherein the step of operating a graduated sensory alert comprises operating a visual alert.

14. The method of claim 13, wherein the step of operating a visual alert comprises operating a light emitting arrangement that changes color as the person or object approaches the detector.

15. The method of claim 14, wherein the step of operating the light emitting arrangement comprises operating a series of individual differently colored light emitting members so as to progressively actuate the differently colored light emitting members as the person or object approaches the detector.

16. The method of claim 15, wherein the step of operating a series of individual differently colored light emitting members comprises operating a series of light emitting diodes.

17. The method of claim 14, wherein each sensor includes a housing defining an interior within which one or more sensing components are contained, and wherein the step of operating the light emitting arrangement comprises operating a series of illumination members that are interconnected with the housing so as to be visible from an exterior of the housing.

* * * * *